US011952236B2

(12) United States Patent
Kubota

(10) Patent No.: US 11,952,236 B2
(45) Date of Patent: Apr. 9, 2024

(54) SHEET PROCESSING APPARATUS AND IMAGE FORMING SYSTEM

(71) Applicant: Hideyuki Kubota, Yamanashi (JP)

(72) Inventor: Hideyuki Kubota, Yamanashi (JP)

(73) Assignee: CANON FINETECH NISCA INC., Misato (JP)

( * ) Notice: Subject to any disclaimer, the term of this patent is extended or adjusted under 35 U.S.C. 154(b) by 224 days.

(21) Appl. No.: 17/539,489

(22) Filed: Dec. 1, 2021

(65) Prior Publication Data

US 2022/0177258 A1 Jun. 9, 2022

(30) Foreign Application Priority Data

Dec. 4, 2020 (JP) ..... 2020-201457

(51) Int. Cl.

| | |
|---|---|
| ***B65H 45/20*** | (2006.01) |
| ***B65H 31/02*** | (2006.01) |
| ***B65H 43/06*** | (2006.01) |
| ***B65H 45/16*** | (2006.01) |
| ***B65H 45/26*** | (2006.01) |

(52) U.S. Cl.

CPC ..... *B65H 45/16* (2013.01); *B65H 31/02* (2013.01); *B65H 43/06* (2013.01); *B65H 45/26* (2013.01); *B65H 2701/13212* (2013.01)

(58) Field of Classification Search

CPC ..... B31F 1/10; B65H 31/02; B65H 43/06; B65H 45/16; B65H 45/18; B65H 45/20; B65H 45/26; B65H 45/101; B65H 2701/13212

USPC ..... 270/32, 39.01; 493/409, 410, 439, 440, 493/442–445

See application file for complete search history.

(56) References Cited

U.S. PATENT DOCUMENTS

| | | | | |
|---|---|---|---|---|
| 7,503,556 | B2 * | 3/2009 | Sugimoto | B65H 45/18 270/32 |
| 7,523,593 | B2 * | 4/2009 | Aoyagi | B65H 37/04 270/58.08 |
| 7,597,311 | B2 * | 10/2009 | Kawata | B65H 45/18 270/32 |
| 8,162,303 | B2 * | 4/2012 | Fukatsu | B65H 45/18 270/32 |
| 8,894,558 | B2 * | 11/2014 | Matsuzaki | B65H 45/18 270/32 |
| 9,102,116 | B2 * | 8/2015 | Suzuki | B65H 45/30 |
| 11,203,506 | B2 * | 12/2021 | Katayama | B65H 37/06 |

FOREIGN PATENT DOCUMENTS

| | | |
|---|---|---|
| JP | 2011-184140 A | 9/2011 |
| JP | 2012-056674 A | 3/2012 |

* cited by examiner

*Primary Examiner* — Leslie A Nicholson, III

(74) *Attorney, Agent, or Firm* — Manabu Kanesaka

(57) ABSTRACT

To prevent displacement of first fold positions and collapse of discharged and stacked sheets when sheet fold processing is performed a plurality of times for each sheet. First fold processing is applied to a sheet conveyed to a conveying path by a rotating body pair 22. The sheet that has been subjected to the first fold processing is fed back to the conveying path while a first fold line is being opened. Then, second fold processing is applied to the sheet that has been fed back to the conveying path by the rotating body pair 22. The resultant sheet is discharged with the first fold line opened.

8 Claims, 17 Drawing Sheets

SHEET PROCESSING APPARATUS AND IMAGE FORMING SYSTEM

TECHNICAL FIELD

The present invention relates to a sheet processing apparatus for folding sheets fed from, for example, an image forming apparatus and an image forming system having the same.

BACKGROUND ART

There is conventionally known a sheet processing apparatus having a function of folding a sheet bundle into a booklet form as post-processing for sheets discharged from an image forming apparatus, such as a copier, a printer, a facsimile device, or a compound machine thereof. An example of this includes a sheet processing apparatus having a mechanism wherein sheets, which are fed from an image forming apparatus to be carried out to a sheet stacker, are thrust at its predetermined position toward the nip portion of a fold roller pair with a thrust plate while being folded and made to pass through the fold roller pair so as to be folded in two.

Some of the sheet processing apparatuses that perform sheet fold processing are configured to perform not only twofold processing but inward threefold processing in which a sheet is subjected to fold processing at two different positions such that one end of the sheet is inside the folded part (see JP2011-184140A and JP2012-56674A).

DISCLOSURE OF INVENTION

Problems to be Solved by the Invention

Both JP2011-184140A and JP2012-056674A disclose technology to apply the inward threefold processing to the sheet while the apparatuses described therein have different configurations. However, when the sheet has been subjected to the inward threefold processing, the length of the sheet in the sheet conveying direction is apparently about ⅓ of the sheet before being folded. Therefore, as illustrated in FIG. 19, when sheets that have been subjected to inward threefold processing are sequentially discharged to a stack tray 200, they are unstably stacked, with the result that sheet alignment performance upon sheet discharge may be deteriorated, or discharged sheet bundle may collapse.

It is therefore an object of the present invention to provide a sheet processing apparatus capable of improving the alignment performance of sheets that have been subjected to fold processing and discharged to a stack tray and an image forming system having such a sheet processing apparatus.

Means for Solving the Problem

To attain the above object, a sheet processing apparatus according to the present invention includes: a conveying path that guides a sheet conveyed in a predetermined conveying direction; a position adjusting unit that moves the sheet conveyed to the conveying path in the conveying direction of the conveying path and its opposite direction so as to adjust the position of the sheet; a fold rotating body pair disposed opposite to a surface of the sheet conveyed to the conveying path, having a nip part that nips a first fold position extending in a sheet width direction intersecting the conveying direction of the sheet conveyed to the conveying path and a second fold position extending in the sheet width direction at a different position from the first fold position to apply fold processing to the sheet, and configured to be rotatable in a first direction so as to perform the fold processing and in a second direction opposite to the first direction so as to feed back the sheet to the conveying path; a biasing unit that biases the first and second fold positions of the sheet that have been adjusted by the position adjusting unit toward the nip part of the fold rotating body pair; and a control unit that controls the position adjusting unit, fold rotating body pair, and biasing unit to perform partly-opened fold processing, the partly-opened fold processing including: forming a first fold line at the first fold position of the sheet position-adjusted by the position adjusting unit and biased by the biasing unit by rotating the fold rotating body pair in the first direction; stopping the rotation of the fold rotating body pair during which time one of upstream and downstream side end edges of the sheet in the conveying direction that is closer to the first fold line is positioned in the conveying path and then rotating the fold rotating body pair in the second direction to feed back the sheet while opening the first fold line at which the fold processing has been applied; and applying fold processing at the second fold position position-adjusted by the position adjusting unit and biased by the biasing unit by rotating the fold rotating body pair in the first direction.

In the present invention, when fold processing is applied at two different first and second positions, the first position is subjected to formation of a fold line, and the second position is subjected to fold processing. The thus processed sheet, in which only the fold line is formed at the first position, is discharged from the device in a state where a part of the sheet is folded inward. The sheets thus folded and discharged are stacked on the already discharged sheet in such a manner that the fold lines of the sheets overlap one another. Thus, sheet alignment performance upon discharge can be appropriately maintained.

MODE FOR CARRYING OUT THE INVENTION

First Embodiment

Figure 1:
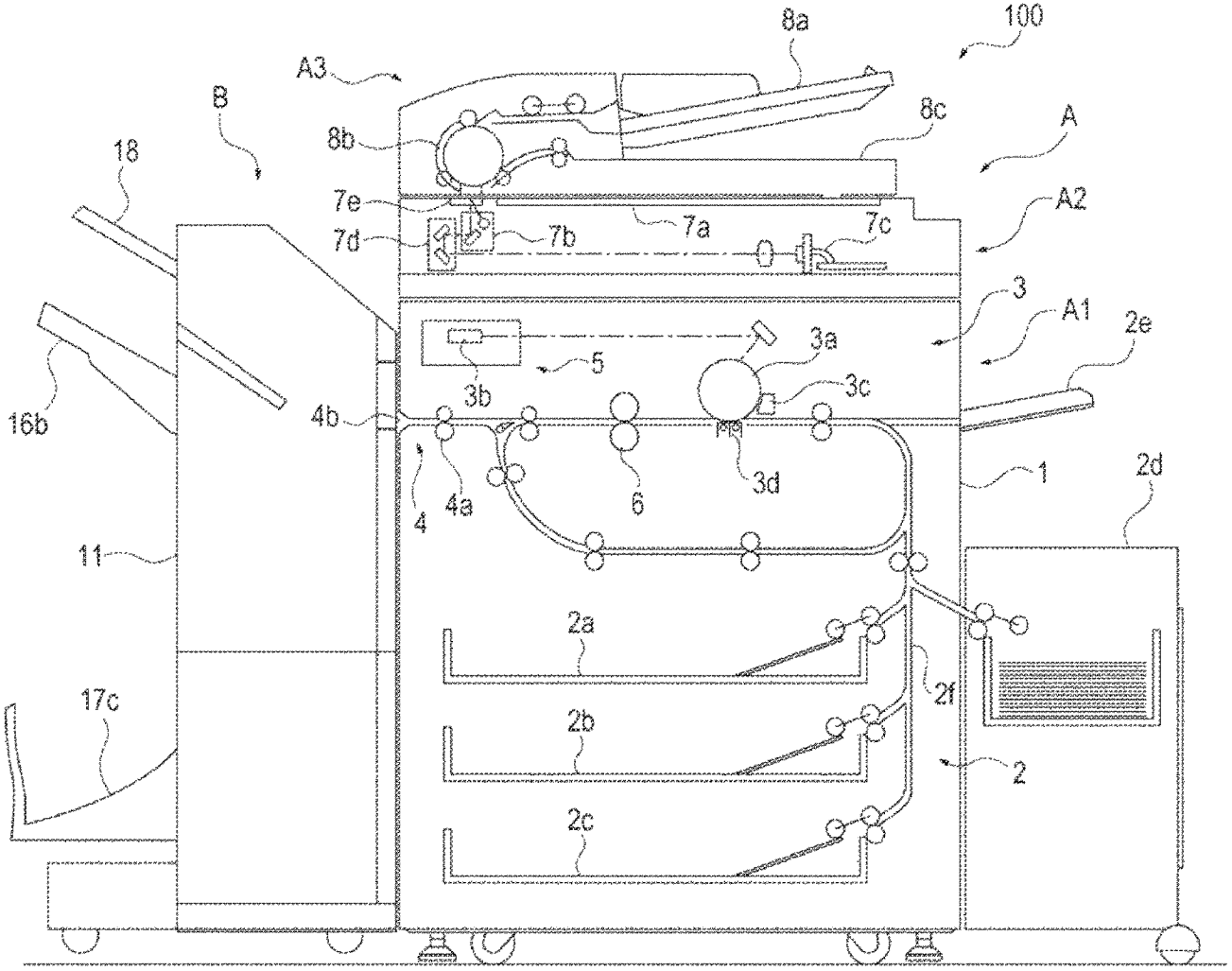
FIG. 1 is an explanatory view illustrating the entire configuration of an image forming system according to the present embodiment.

Hereinafter, a sheet processing apparatus according to preferred embodiments of the present invention and an image forming system having the same will be described with reference to the drawings. FIG. 1 schematically illustrates the entire configuration of an image forming system having a sheet processing apparatus according to the embodiments of the present invention. As illustrated in FIG. 1, an image forming system 100 includes an image forming apparatus A and a sheet processing apparatus B installed together therewith.

<Entire Configuration of Image Forming Apparatus>

The image forming apparatus A includes an image forming unit A1, a scanner unit A2, and a feeder unit A3. The image forming unit A1 includes, inside a housing 1, a feed part 2, an image forming part 3, a discharge part 4, and a data processing part 5.

The feed part 2 has a plurality of cassette mechanisms 2*a*, 2*b*, and 2*c* for storing image formation sheets of different sizes and delivers sheets of a size designated from a not-shown main body control part to a feed path 2*f*. The cassette mechanisms 2*a*, 2*b*, and 2*c* are each configured to be detachable from the feed part 2 and each incorporate a separating mechanism for separating sheets therein one by one and a feed mechanism for delivering sheets. The feed path 2*f* has a conveying roller for conveying sheets fed from the cassette mechanisms 2*a*, 2*b*, and 2*c* to the downstream and has, at its end, a registration roller pair for aligning sheet front ends.

The feed path 2*f* is connected with a large capacity cassette 2*d* and a manual feed tray 2*e*. The large capacity cassette 2*d* is constituted by an option unit for storing sheets of a size to be consumed in a large amount. The manual feed tray 2*e* is configured to feed thick sheets which are difficult to separate upon feeding and special sheets such as coated sheets and film sheets.

The image forming part 3 uses an electrophotographic system and has a rotating photosensitive drum 3*a* and an emitter 3*b* for emitting optical beam, a developing unit 3*c*, and a cleaner (not shown) which are disposed around the photosensitive drum 3*a*. The illustrated image forming part 3 is a monochrome printing mechanism and configured to irradiate the photosensitive drum 3*a* whose circumferential surface is uniformly electrically charged with light corresponding to an image signal using the emitter 3*b* to optically form a latent image and to attach toner ink to the latent image using the developing unit 3*c* to form a toner image.

A sheet is fed along the feed path 2*f* to the image forming part 3 at the timing of image formation on the photosensitive drum 3*a*, and a transfer bias is applied from a transfer charger 3*d* to the sheet to transfer the toner image formed on the photosensitive drum 3*a* onto the sheet. The sheet onto which the toner image has been transferred passes through a fixing unit 6 while being heated and pressurized, with the result that the toner image is fixed onto the sheet. The resultant sheet is then discharged from a discharge port 4*b* by a discharge roller 4*a* and conveyed to the sheet processing apparatus B to be described later.

The scanner unit A2 includes a platen 7*a* on which an image document is placed, a carriage 7*b* configured to reciprocate along the platen 7*a*, a photoelectric conversion unit 7*c*, and a reduction optical system 7*d* that guides reflecting light from the document on the platen 7*a* scanned by the carriage 7*b* to the photoelectric conversion unit 7*c*. The photoelectric conversion unit 7*c* photoelectric-converts an optical output from the reduction optical system 7*d* into image data and outputs the image data to the image forming part 3 as an electric signal.

The scanner unit A2 further includes a platen 7*e* so as to read the sheet fed from the feeder unit A3. The feeder unit A3 includes a feed tray 8*a* on which document sheets are loaded, a feed path 8*b* that guides the document sheet fed from the feed tray 8*a* to the platen 7*e*, and a discharge tray 8*c* that stores the document sheet that has passed through the platen 7*e*. The document sheet from the feed tray 8*a* is read by the carriage 7*b* and reduction optical system 7*d* when passing through the platen 7*e*.

<Entire Configuration of Sheet Processing Apparatus>

The following describes the entire configuration of the sheet processing apparatus B that applies post-processing to sheets fed from the image forming apparatus A.

Figure 2:
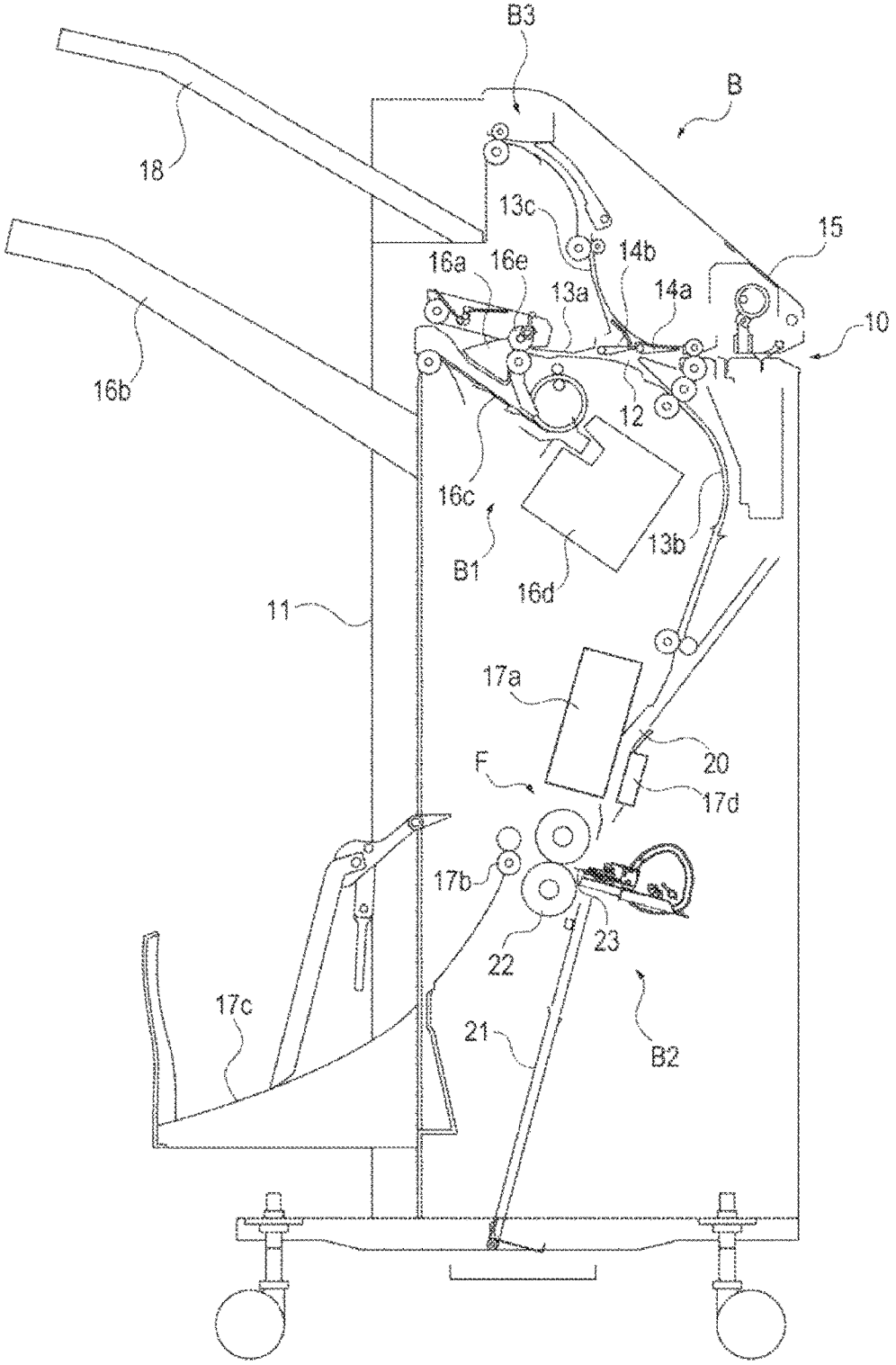
FIG. 2 is an explanatory view illustrating the entire configuration of a sheet processing apparatus in the image forming system.

FIG. 2 is an explanatory view illustrating the configuration of the sheet processing apparatus B according to the present embodiment. The sheet processing apparatus B has a housing 11 provided with a carry-in port 10 for introducing sheets from the image forming apparatus A. The housing 11 is positioned such that the carry-in port 10 communicates with the discharge port 4*b* provided in the housing 1 of the image forming apparatus A.

The sheet processing apparatus B has a sheet carry-in path 12 along which the sheet introduced from the carry-in port 10 is conveyed, first to third discharge paths 13*a*, 13*b*, and 13*c* branching from the sheet carry-in path 12, and first and second path switch units 14*a* and 14*b*. The first and second path switch units 14*a* and 14*b* are each constituted by a flapper guide that changes the conveying direction of the sheet conveyed along the sheet carry-in path 12.

The first path switch unit 14*a* uses a not-shown drive unit to switch between a mode that guides the sheet from the carry-in port 10 toward the first discharge path 13*a* for conveying the sheet in the lateral direction without changing the direction, a mode that guides the sheet from the carry-in port 10 toward the second discharge path 13*b* for conveying the sheet downward, and a mode that guides the sheet from the carry-in port 10 toward the third discharge path 13*c* for conveying the sheet upward. The first and second discharge paths 13*a* and 13*b* communicate with each other so as to allow the sheet that has once been introduced to the first discharge path 13*a* to be switchback-conveyed to the second discharge path 13*b* with the sheet conveying direction reversed.

The second path switch unit 14*b* is arranged at a downstream location from the first path switch unit 14*a* in the conveying direction of the sheet conveyed along the sheet carry-in path 12. The second path switch unit 14*b* uses the not-shown drive unit to switch between a mode that introduces the sheet that has passed through the first path switch unit 14*a* to the first discharge path 13*a* and a mode that switchback-conveys the sheet that has once been introduced to the first discharge path 13*a* to the second discharge path 13*b*.

The sheet processing apparatus B includes first to third processing parts B1, B2, and B3 which perform different types of post-processing. Further, the sheet carry-in path 12 is provided with a punch unit 15 that punches a hole in the sheet carried therein.

The first processing part B1 is a binding processing part. Specifically, the first processing part B1 accumulates, aligns, and binds a plurality of sheets that have been discharged from a discharge port 16*a* at the downstream end of the first discharge path 13*a* in the conveying direction of the sheet conveyed along the sheet carry-in path 12 and then discharges the bound sheet bundle to a stack tray 16*b* provided outside the housing 11. The first processing part B1 has a sheet conveying device 16*c* that conveys a sheet or a sheet bundle and a binding processing unit 16*d* that binds a sheet bundle. The first discharge path 13*a* has, at its downstream end, a discharge roller pair 16*e* for sheet discharge from the discharge port 16*a* and for switchback conveyance from the first discharge path 13*a* to the second discharge path 13*b*.

The second processing part B2 is a fold processing part. Specifically, the second processing part B2 forms a sheet bundle by stacking a sheet or a plurality of sheets switchback-conveyed from the second discharge path 13*b*, binds the sheets or sheet bundle, followed by fold processing. As described will be later, the second processing part B2 has a fold processing device F that folds the sheet or sheet bundle carried therein and a binding processing unit 17*a* arranged at an immediately upstream location relative to the fold processing device F in the conveying direction of the sheet conveyed toward the second discharge path 13*b* and binds a sheet bundle. The sheet or sheet bundle that has been subjected to fold processing is discharged onto a stack tray 17*c* provided outside the housing 11 by a discharge roller 17*b*.

The third processing part B3 performs jog sorting to sort the sheets fed from the third discharge path 13*c* into a group stacked so as to be offset by a predetermined amount in the sheet width direction perpendicular to the conveying direction and a group stacked without being offset. The jog-sorted sheets are discharged onto a stack tray 18 provided outside the housing 11, and the sheet bundle of the offset group and the sheet bundle of the non-offset group are stacked on the stack tray 18.

<Fold Processing Device>

Figure 3:
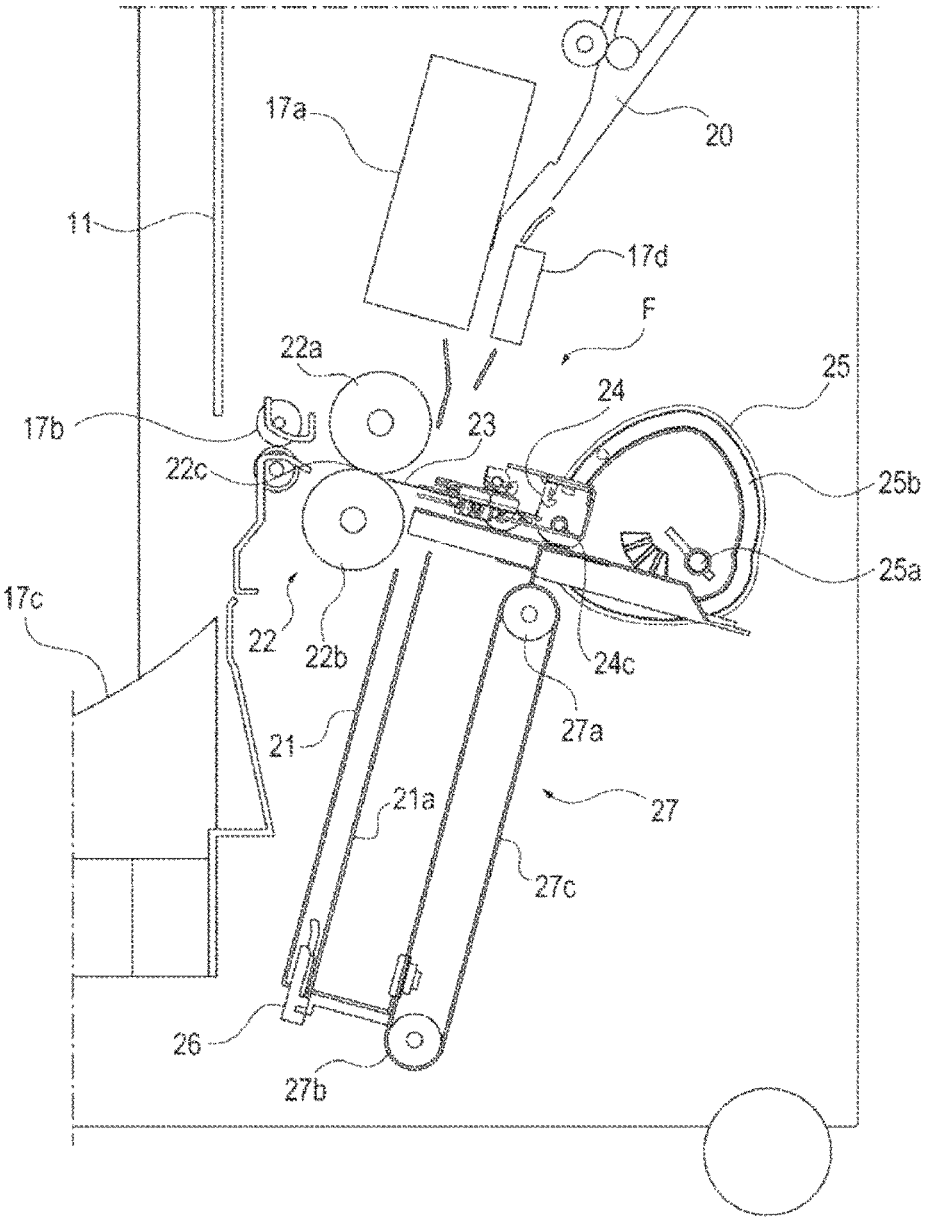
FIG. 3 is a cross-sectional view illustrating a fold processing device of the sheet processing apparatus.

FIG. 3 schematically illustrates the entire configuration of the second processing part B2. As described above, the second processing part B2 has the fold processing device F that folds in two the sheet or sheet bundle carried therein from the second discharge path 13*b* and stacked in a collated manner and the binding processing unit 17*a* that binds a sheet bundle before being folded. The illustrated binding processing unit 17*a* is a stapler device that drives a staple needle into a sheet bundle to bind it.

The second discharge path 13*b* is connected with a sheet conveying path 20 so as to carry sheets into the fold processing device F. An intermediate tray 21 constituting a part of the sheet conveying path 20 is provided downstream of the sheet conveying path 20 in the conveying direction of the sheet conveyed from the second discharge path 13*b* to the intermediate tray 21. On the intermediate tray 21, sheets to be folded are positioned and stacked. The binding processing unit 17*a* and a needle receiving part 17*d* are provided at immediately upstream locations relative to the intermediate tray 21 so as to face each other across the sheet conveying path 20.

A fold roller pair 22 as a fold rotating body pair is provided on one side of the intermediate tray 21 in the sheet thickness direction so as to face one surface of the sheet or sheet bundle conveyed to the intermediate tray 21. The fold roller pair 22 is composed of fold rollers 22*a* and 22*b* whose circular roller surfaces are brought into pressure contact with each other, and a nip part 22*c*, which is the pressure contact part therebetween and disposed facing the intermediate tray 21. The fold rollers 22*a* and 22*b* are juxtaposed respectively on the upstream and downstream sides in the conveying direction of the sheet conveyed to the intermediate tray 21 from the upstream side above the intermediate tray 21 to the downstream side below the intermediate tray 21 in such a way as to be both equally distanced from the intermediate tray 21. In the present invention, the rotating part functioning as the fold rotating body is not limited to the fold rollers 22*a* and 22*b* related to the present embodiment, but may be, for example, a rotating belt. Further, the fold roller pair 22 may have a configuration in which a plurality of rollers (rotating bodies) are continuously disposed in series along the axial direction of each of the fold rollers 22*a* and 22*b*.

The fold roller pair 22 is made of a rubber material or the like having a comparatively high friction coefficient as in the roller surface of the roller used for typical sheet conveyance.

A fold blade 23 serving as a biasing unit for biasing a sheet against the fold roller pair 22 is disposed on the side opposite to the fold roller pair 22 with respect to the intermediate tray 21. The fold blade 23 is supported on a blade carrier 24 with its distal end facing the nip part 22*c* of the fold roller pair 22. The blade carrier 24 can be made to travel by a moving unit constituted by a cam member or the like to a direction traversing the intermediate tray 21 at substantially right angles, i.e., a direction intersecting the conveying direction of the sheet conveyed from the second discharge path 13*b* to the intermediate tray 21.

A cam member 25 composed of a pair of eccentric cams (only one eccentric cam is illustrated in FIG. 3), which are mirror-symmetric with each other, are provided so as to face each other across the blade carrier 24 in the front-rear direction (axial direction of the fold roller) in FIG. 3. The cam member 25 is rotated by a drive unit such as a drive motor about a rotary shaft 25*a* provided at the eccentric position. The cam member 25 has a cam groove 25*b* along the outer peripheral edge thereof.

The blade carrier 24 has, as a cam follower, a cam pin 24*c* freely slidably fitted in the cam groove 25*b*.

The blade carrier 24 can be caused to reciprocally travel by a drive motor rotating the cam member 25 in a direction approaching or separating from the intermediate tray 21. This allows the fold blade 23 to linearly freely move forward and backward between an initial position where the distal end of the fold blade 23 does not enter the sheet conveying path formed by a guide surface 21*a* of the intermediate tray 21 and a maximum protruding position where the distal end of the fold blade 23 is nipped at the nip part 22c of the fold roller pair 22 as illustrated in FIG. 3 along a protruding path connecting both the initial and maximum protruding positions.

A regulating stopper 26 is disposed at the lower end of the intermediate tray 21. The regulating stopper 26 serves as a position adjusting unit for adjusting a sheet position with respect to the intermediate tray 21. To this end, the regulating stopper 26 is configured to make the front end of the conveyed sheet in the conveying direction abut thereagainst for regulating and to move, in this state, in the conveying direction and the direction opposite to the conveying direction in the sheet conveying path. The regulating stopper 26 can be elevated and lowered along the intermediate tray 21 by a sheet elevating/lowering mechanism 27.

The sheet elevating/lowering mechanism 27 according to the present embodiment is a conveyer belt mechanism disposed on the side opposed to the fold roller pair 22 with respect to the intermediate tray 21 and below the blade carrier 24 when being located at the initial position where the distal end of the fold blade 23 does not enter the sheet conveying path formed by the intermediate tray 21 and includes a pair of pulleys 27a and 27b disposed respectively near the upper and lower ends of the intermediate tray 21 along the intermediate tray 21 and a transmission belt 27c wound around the pulleys to constitute a conveyer belt mechanism. The regulating stopper 26 is fixed onto the transmission belt 27c. Rotating the drive side pulley 27a or 27b by a drive unit such as a drive motor allows the regulating stopper 26 to be elevated and lowered between the lower end position illustrated in FIG. 3 and a predetermined height position to thereby move a sheet or a sheet bundle along the intermediate tray 21 for positioning thereof at a predetermined height position.

Figure 4:
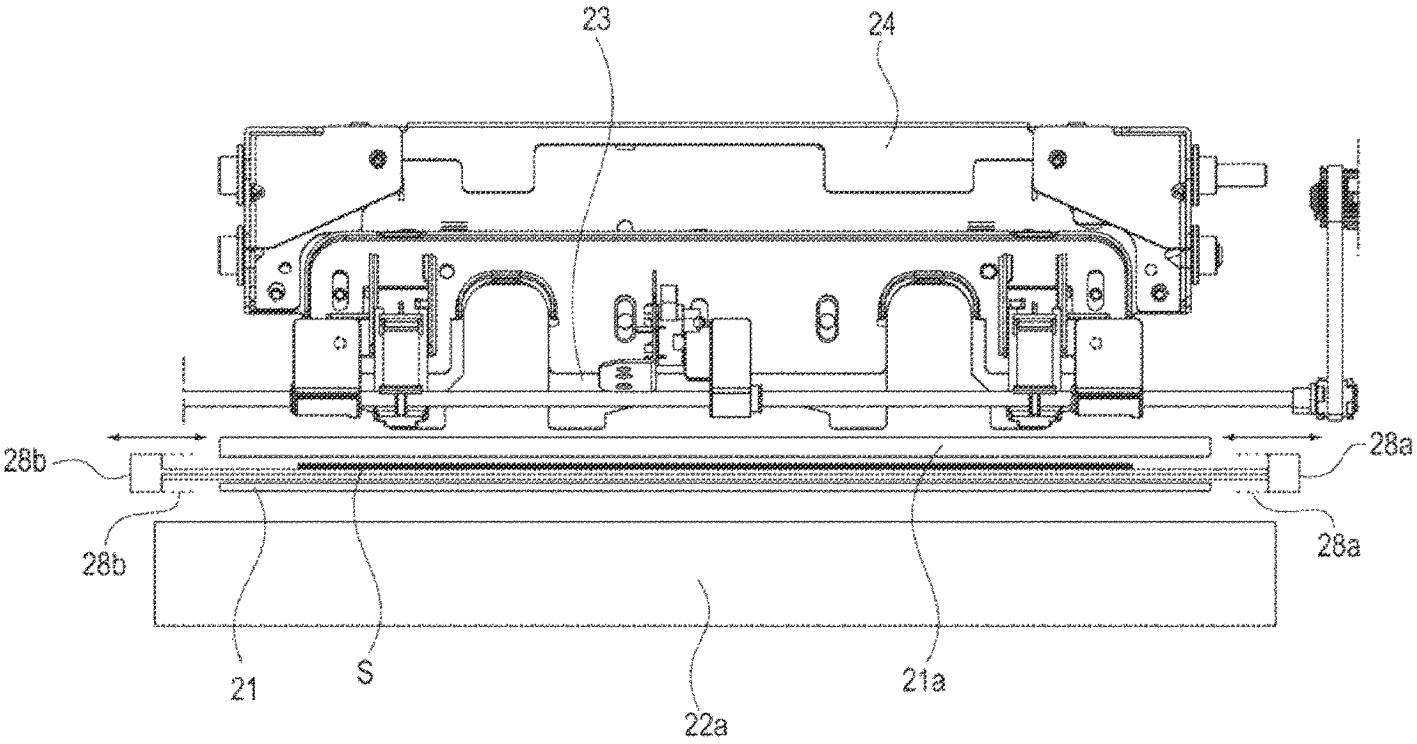
FIG. 4 is a plan view illustrating the fold processing device.

The fold processing device F according to the present embodiment further has a sheet side aligning mechanism for aligning the side (end edge of the sheet in the width direction intersecting the conveying direction) of the sheet to be carried in the intermediate tray 21. As illustrated in FIG. 4, the sheet side aligning mechanism has a pair of sheet side aligning members 28a and 28b symmetrically disposed on both sides of the intermediate tray 21 in the sheet width direction (direction perpendicular to the sheet conveying direction). FIG. 4 is a schematic plan view as viewed from above the fold processing device F. The sheet side aligning members 28a and 28b are movably supported so as to relatively approach and separate from each other in the sheet width direction. The sheet side aligning members 28a and 28b are moved with respect to the sheets that has abutted, at its front end, against the regulating stopper 26, whereby the position of the sheet in the sheet width direction is aligned.

As described above, in the fold processing, the sheet biased (thrust) by the fold blade 23 is made to pass through the nip part 22c of the fold roller pair 22. The fold processing device F according to the present embodiment is featured in that the interval between rotary shafts 22a1 and 22b1 of the fold rollers 22a and 22b is changeable. That is, changing the interval by the drive of a pressure changing motor allows adjustment of the pressing force at the nip part 22c.

Figure 5:
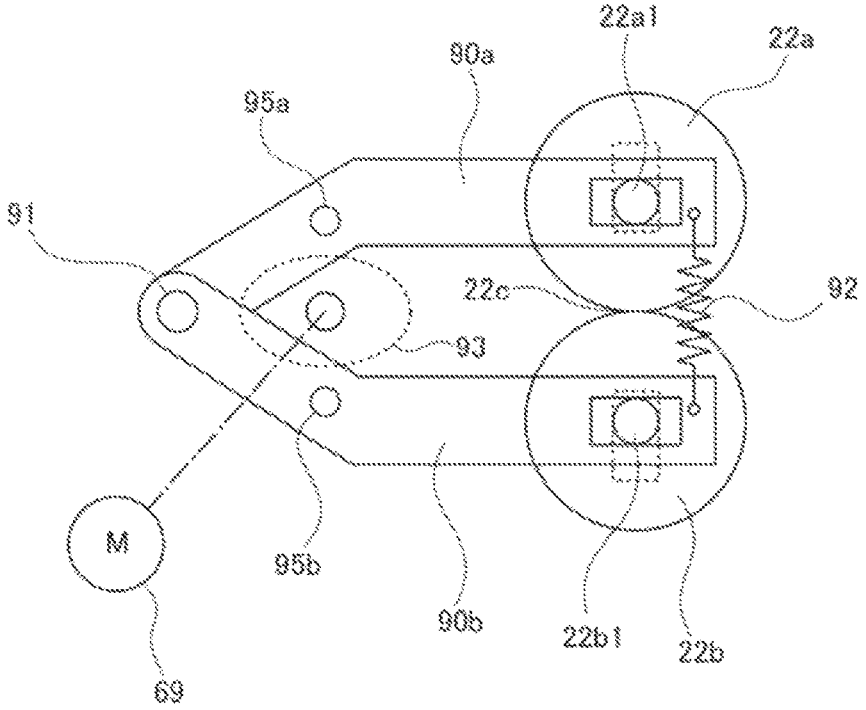
FIG. 5 is an explanatory view of the pressing force adjusting configuration of a fold roller pair.

The pressure changing unit according to the present embodiment that can change the pressing force at the nip part 22c is configured as follows. That is, as illustrated in FIG. 5, the fold rollers 22a and 22b are freely turnably fitted respectively to the one end portions of arm members 90a and 90b, and the other end portions of the arm members 90a and 90b are supported in common by a turning fulcrum 91. The fold rollers 22a and 22b are brought into pressure contact with each other by a tension spring 92 fitted to the arm members 90a and 90b to apply a predetermined pressing force to the sheet passing through the roller nip part 22c.

An elliptical eccentric cam 93 is fitted near the turning fulcrum 91 so as to be rotatable by a pressure changing motor 69, and the arm members 90a and 90b are provided respectively with pins 95a and 95b engageable with both ends of the long-diameter portion of the eccentric cam 93. When the eccentric cam 93 does not abut against the pins 95a and 95b, the fold rollers 22a and 22b are brought into pressure contact with each other, and when the eccentric cam 93 is rotated from this position, the pins 95a and 95b are engaged with the eccentric cam 93 to be pushed. As a result, the arm members 90a and 90b are turned about the turning fulcrum 91 to separate the fold rollers 22a and 22b from each other.

<Control Part>

Figure 6:
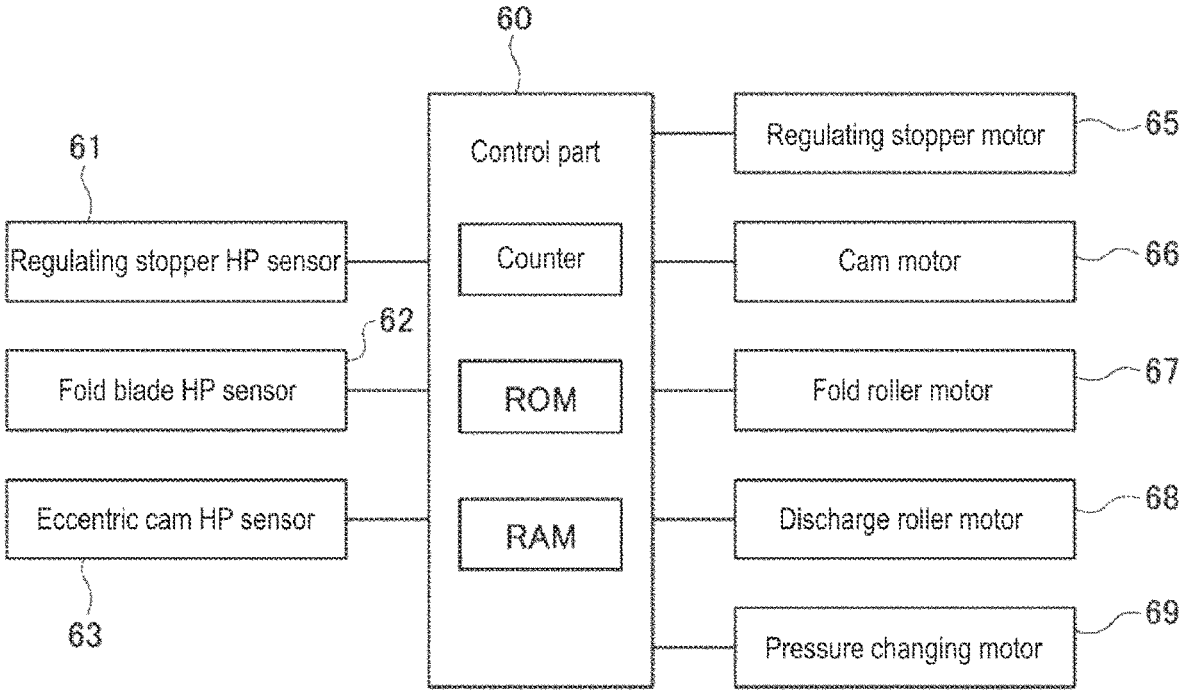
FIG. 6 is a block diagram of a fold processing control configuration.

The following describes the control configuration of the drive system in the sheet fold processing. As illustrated in the block diagram of FIG. 6, a control part 60 receives inputs of detection signals or various processing signals from various types of detection sensors and controls the drive of the various types of drive motors according to the input signals. For example, the various types of detection sensors include a regulating stopper HP sensor 61 for detecting whether the regulating stopper 26 is located at its home position, a fold blade HP sensor 62 for detecting whether the fold blade 23 is located at its home position, and an eccentric cam HP sensor 63 for detecting the home position of the eccentric cam 93.

Figure 7:
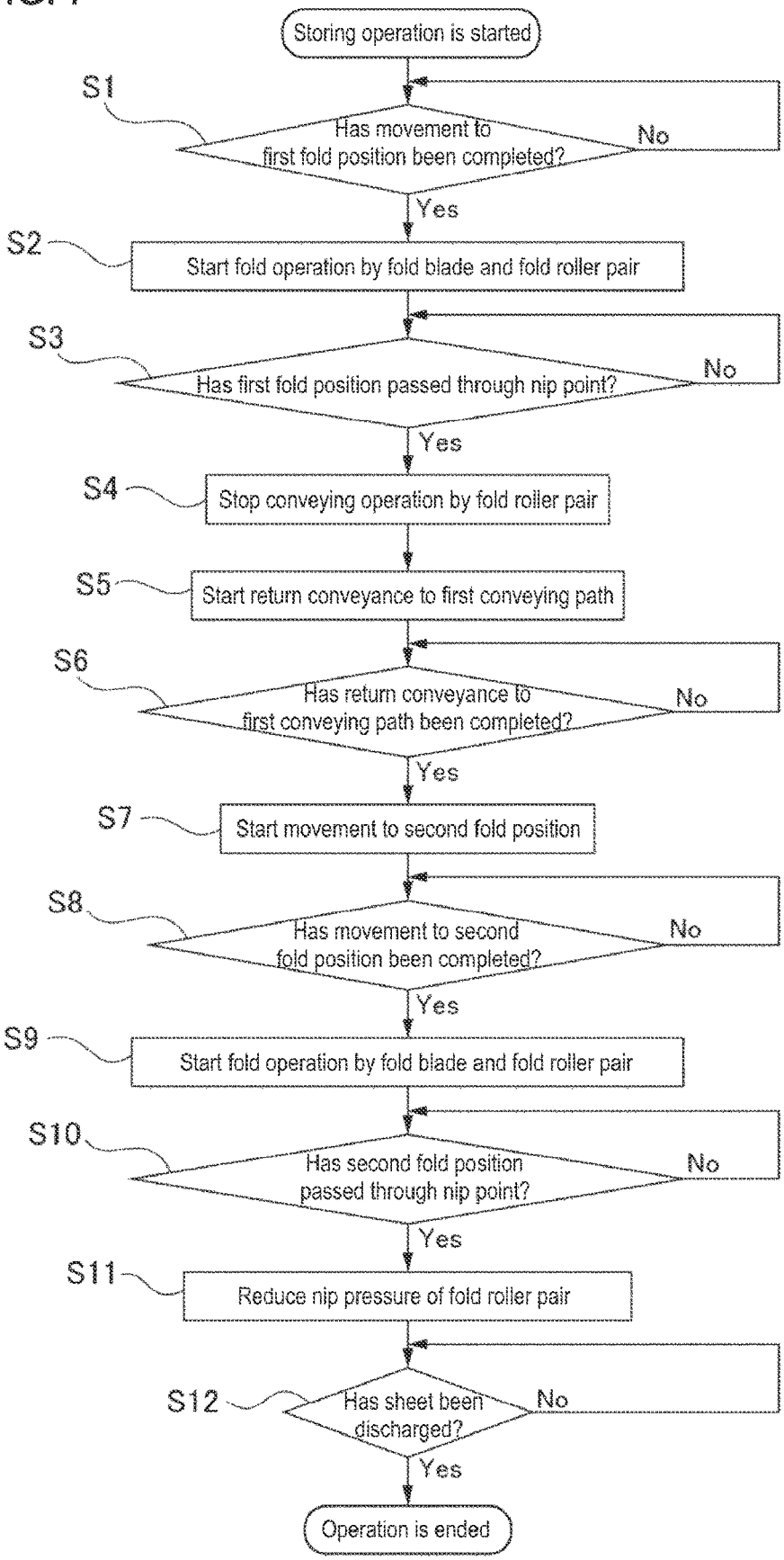
FIG. 7 is a flowchart illustrating a threefold processing sequence.

The control part 60 drive-controls various types of motors in response to the received input signals, in the sequence of flowchart illustrated in FIG. 7. The various types of motors include a regulating stopper motor 65 that drives the sheet elevating/lowering mechanism for elevating and lowering the regulating stopper 26, a cam motor 66 that drives the cam member 25 for operating the blade carrier 24, a fold roller motor 67 that drives the fold roller pair 22 into rotation, a discharge roller motor 68 that drives the discharge roller 17b serving as a sheet conveying unit into rotation, and a pressure changing motor 69 that can move the rotary shafts 22a1 and 22b1 of the fold rollers 22a and 22b.

<Fold Processing Operation>

FIG. 7 is a flowchart illustrating the operation sequence of respective members when the sheet that has been conveyed to the intermediate tray 21 is folded in three by the fold processing device F. The threefold processing includes the first fold processing of folding the sheet in two and the second fold processing of folding the sheet at a position different from that in the first fold processing. Specifically, one end portion of the sheet folded in the first fold processing is folded inside the sheet folded in the second fold processing, whereby inward threefold is achieved.

As described above, when the sheets that have been folded in three are discharged, they are unstably stacked. Thus, the fold processing device F according to the present embodiment performs the threefold processing as follows: the sheet is not folded at the fold line in the first fold processing, followed by the second fold processing in this state, and then the resultant sheet (in a state of being folded only in two) is discharged. In the present embodiment, this is referred to as "partly-opened fold processing".

The following describes the operation of the fold processing device F according to the present embodiment when performing the threefold processing with reference to the flowchart of FIG. 7 and schematic cross-sectional views of FIGS. 8A to 11B illustrating the operations of respective components according to the flow of a sheet S in the threefold processing. The threefold processing mentioned here is evenly-spaced threefold processing. Although the following description will be made taking one sheet S as an example in place of a sheet bundle, while the processing to be described below can of course be applied to a sheet bundle composed of a plurality of stacked sheets.

Figure 8B:
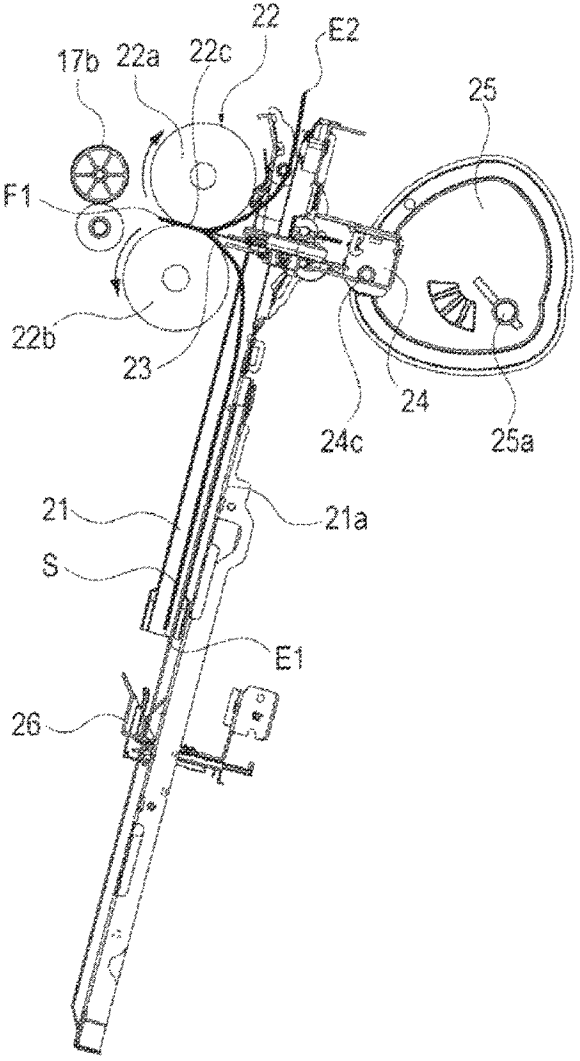
FIGS. 8A and 8B are cross-sectional views for explaining a sheet partly-opened fold processing operation according to a first embodiment.
Figure 8A:
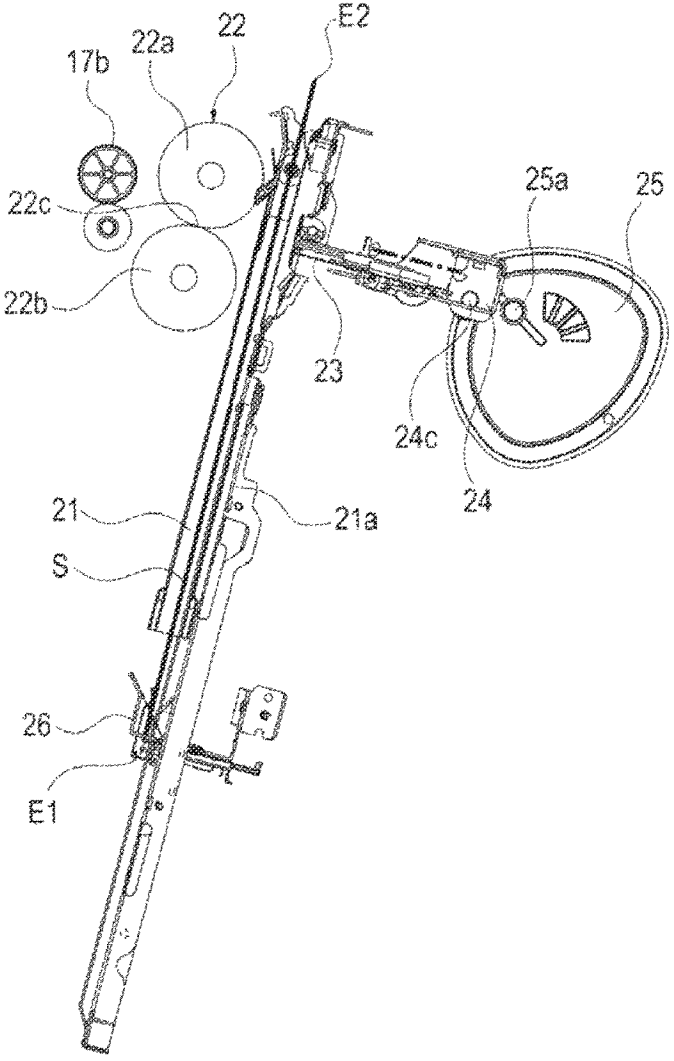

As illustrated in FIG. 8A, the intermediate tray 21 according to the present embodiment is inclined with respect to the vertical direction. The sheet S is conveyed so as to fall, with a downstream side end edge E1 at the bottom and an upstream side end edge E2 at the top, while the surface thereof on one side guided by the guide surface 21*a* constituting the conveying path of the intermediate tray 21 and is stopped when the downstream side end edge E1 abuts against the regulating stopper 26. At this time, the regulating stopper 26 against which the downstream side end edge E1 abuts is moved so as to make a fold position (first fold position) of the sheet S to be formed in the first fold processing align with the fold blade 23 (S1).

The first fold position is a position extending in the sheet width direction intersecting the conveying direction of the sheet S conveyed to the conveying path of the intermediate tray 21 at the position where, when the downstream side end edge E1 of the sheet S conveyed to the intermediate tray 21 abuts against the regulating stopper 26, the position corresponding to ⅔ of the entire length in the conveying direction of the sheet S before being folded from the downstream side end edge E1 aligns with the fold blade 23.

The fold blade 23 is disposed at a position where it thrusts the sheet S from the side of the guide surface 21*a* of the intermediate tray 21 toward the fold roller pair 22. In other words, the guide surface 21*a* of the intermediate tray 21 and the fold roller pair 22 are disposed so as to correspond in position to each other across the sheet S.

When fold processing is started, as illustrated in FIG. 8B, the cam motor 66 is driven to move the blade carrier 24 toward the fold roller pair 22, causing the fold blade 23 to abut against a first fold position F1 of the sheet S to thrust the first fold position F1 toward the nip part 22*c*. Simultaneously, the fold roller motor 67 is driven to rotate the fold roller pair 22 in the normal rotation direction (normal direction mentioned here is defined such that the fold rollers 22*a* and 22*b* rotate clockwise and counterclockwise, respectively) as a first direction (S2). The operation of the fold blade 23 and the rotation of the fold roller pair 22 are started simultaneously here, although it may be configured that the fold roller pair 22 starts rotating after a predetermined period of time has elapsed or after a predetermined number of pulses has counted from the start of the operation of the fold blade 23. When pulse motors are used as the above-mentioned various motors, the number of drive pulses thereof is counted by a counter. When DC motors are used as the above-mentioned various motors, slits of a code wheel (slit plate) attached to the rotary shaft of the motor are read by a sensor, and the number of slits is counted by a counter. Whether or not the first fold position F1 has passed through the nip part 22*c* may be determined using configurations other than counting the number of motor rotations. For example, it may be configured such that the position of the sheet S is detected by a sensor, and the motor driving is controlled according to the detection result.

The rotation of the cam member 25 causes the fold blade 23 to thrust the first fold position F1 of the sheet S toward the nip part 22*c* of the fold roller pair 22 by a predetermined amount. After that, the fold blade 23 advances in the reverse direction to its home position.

The thrust of the fold blade 23 causes the sheet S to be thrust into the nip part 22*c* at which the fold rollers 22*a* and 22*b* of the fold roller pair 22 are brought into contact with each other to be pressed at a predetermined pressing force and folded while being nipped and conveyed by the fold roller pair 22, whereby the first fold processing is completed.

Then, the drive of the fold roller pair 22 is stopped at the point of time when the first fold position F1 passes through the nip part 22*c* by a predetermined distance (S4). Specifically, the driving of the fold roller pair 22 is stopped during which one (in the present embodiment, the upstream side end edge E2) of the downstream side end edge E1 and upstream side end edge E2 in the conveying direction of the sheet S that is closer to the first fold position F1 is positioned in the conveying path of the intermediate tray 21. The stop timing can be controlled by counting (S3) the number of drive pulses from when the cam motor 66 that drives the fold blade 23 is started driving.

Then, the fold roller pair 22 is reversely rotated in a second direction that is the direction opposite to the above first direction to feed back the sheet S in which a first fold line has been formed to the intermediate tray 21 (S5). At this time, both the end edges E1 and E2 of the sheet S are positioned in the sheet conveying path constituted by the intermediate tray 21, so that, as illustrated in FIG. 9A, the sheet S is fed back to the sheet conveying path in an unfolded state, i.e., with the first fold line open, and the sheet S for which nip by the nip part 22*c* has been released falls until the downstream side end edge E1 abuts against the regulating stopper 26 in the sheet conveying path.

Figure 9B:
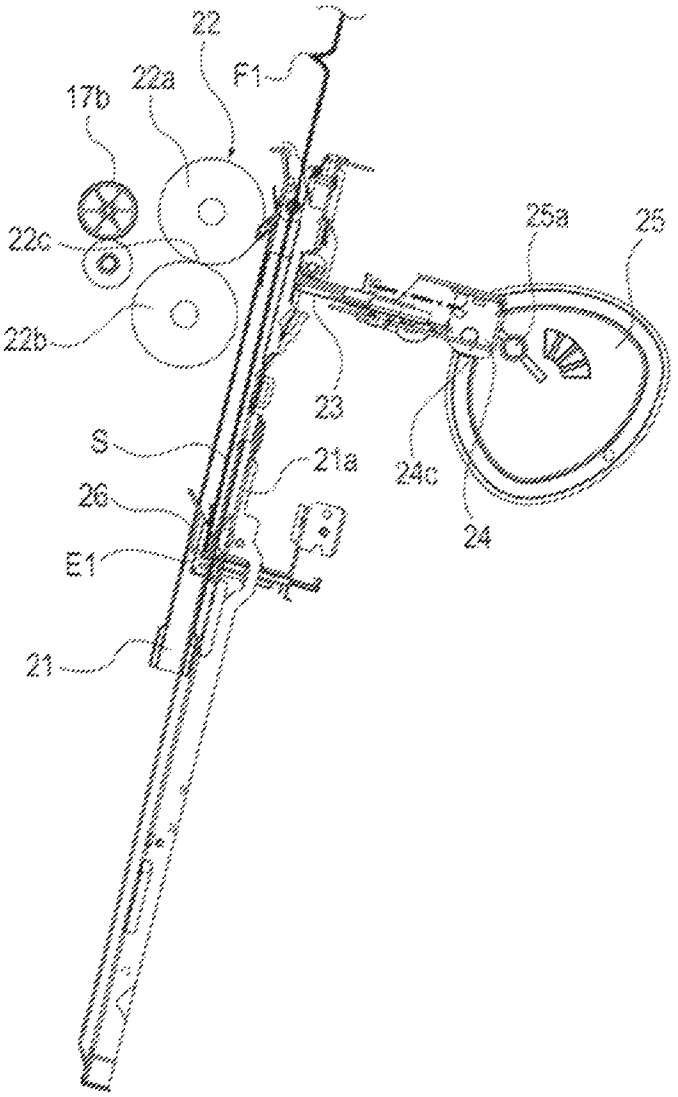
FIGS. 9A and 9B are cross-sectional views for explaining the sheet partly-opened fold processing operation according to the first embodiment.
Figure 9A:
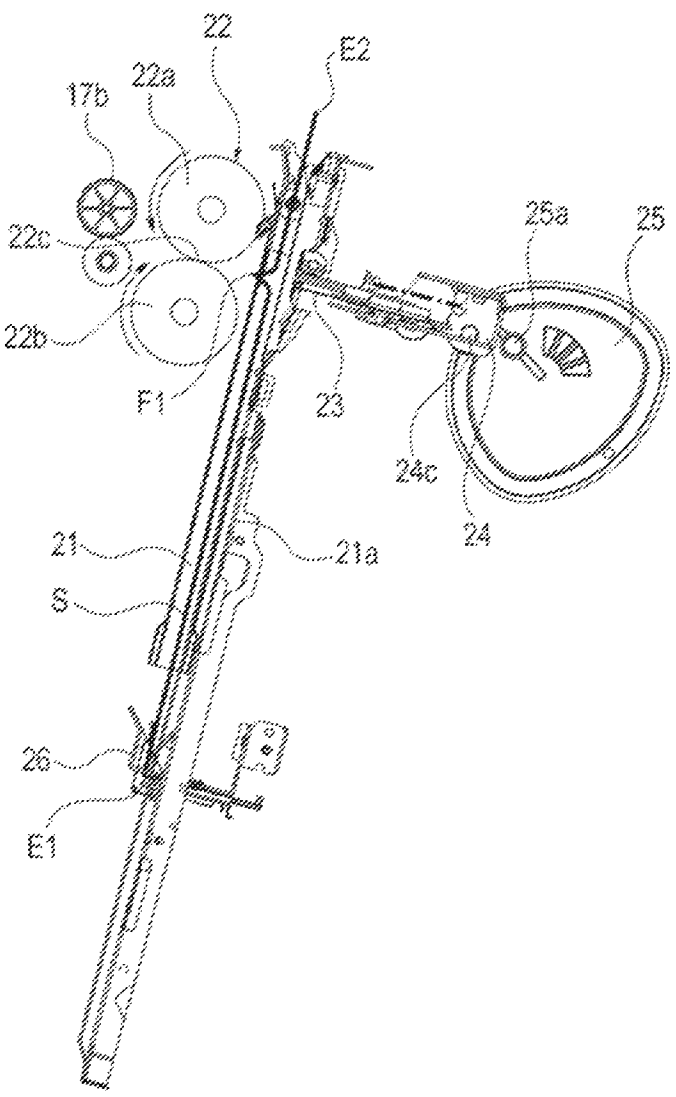

Then, for the second fold processing, as illustrated in FIG. 9B, the regulating stopper motor 65 is driven to elevate the regulating stopper 26 (S7) against which the downstream side end edge E1 of the sheet S abuts so as to make a fold position (second fold position) of the sheet S to be formed in the second fold processing align with the fold blade 23 (S8).

The second fold position is a position extending in the sheet width direction intersecting the conveying direction of the sheet S conveyed to the conveying path of the intermediate tray 21 at the position where the position corresponding to ⅓ of the entire length in the conveying direction of the sheet S from the downstream side end edge E1 aligns with the fold blade 23.

Figure 10B:
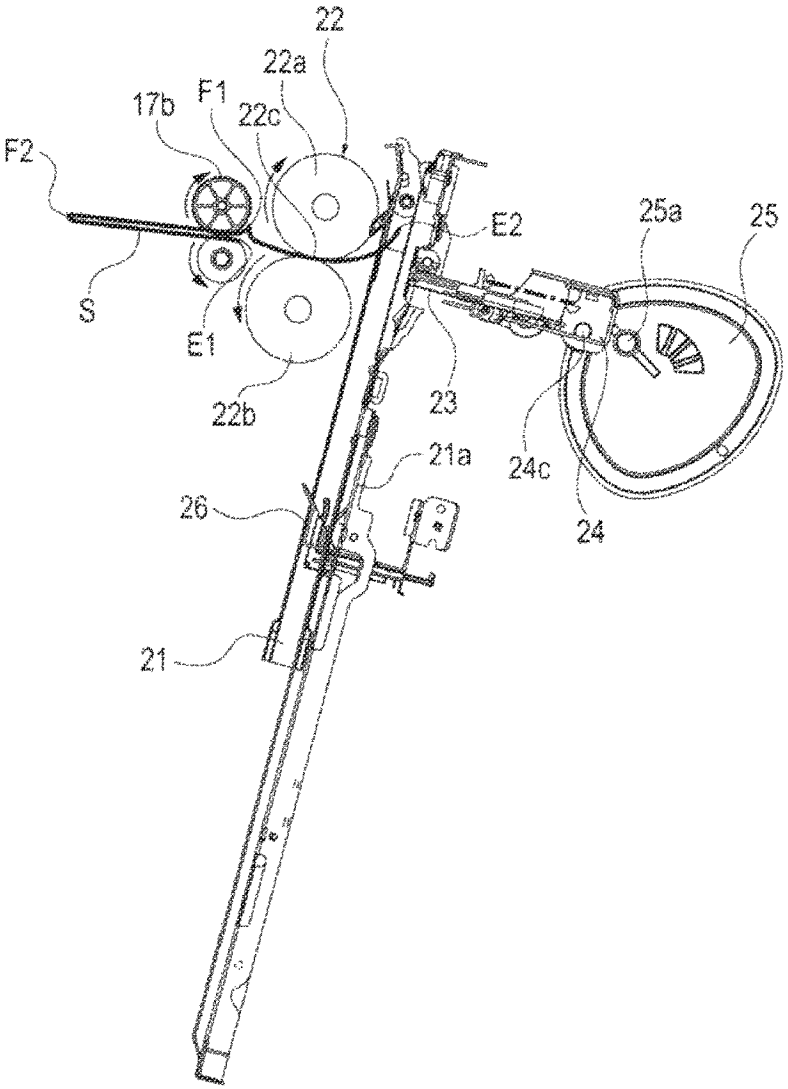
FIGS. 10A and 10B are cross-sectional views for explaining the sheet partly-opened fold processing operation according to the first embodiment.
Figure 10A:
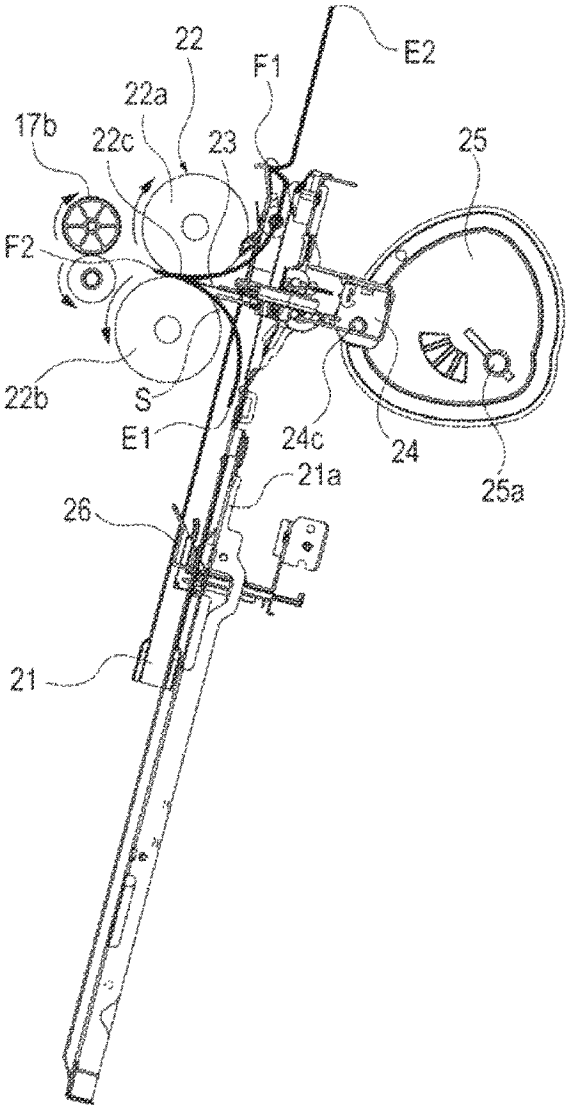

In this state, the cam motor 66 is driven to operate once again the fold blade 23 to cause the fold blade 23 to thrust the sheet S toward the nip part 22*c* of the fold roller pair 22 as illustrated in FIG. 10A (S9).

Then, in sync with the drive of the cam motor 66, the fold roller motor 67 and discharge roller motor 68 are driven into normal rotation. As a result, the sheet S that has been thrust into the fold roller pair 22 by the fold blade 23 passes through the nip part 22*c* at which the fold rollers 22*a* and 22*b* of the fold roller pair 22 are brought into contact with each other. Thus, a predetermined pressing force is applied to the second fold position F2, whereby the second fold processing is completed (S10).

The sheet S that has been subjected to the second fold processing is folded in two at the second fold position F2 as illustrated in FIG. 10B and discharged onto the stack tray 17*c* by the fold roller pair 22 and discharge roller 17*b* with the first fold position F1 remaining open. At this time, the pressure changing motor 69 is driven after the second fold position F2 passes through the nip part 22*c* and before the first fold position F1 passes through the nip part 22*c* (in the present embodiment, immediately after the second fold position F2 passes through the nip part 22*c*) (S10) to reduce the press contact force at the nip part 22*c* (S11). This prevents the first fold line from collapsing when it passes through the nip part 22*c* in an unfolded state. That is, fold line retention force can be maintained.

Figure 11A:
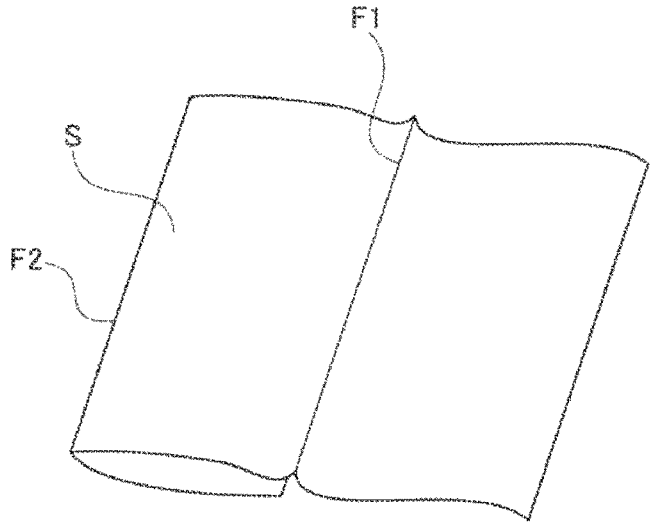
FIG. 11A is a perspective view of a sheet after being subjected to the partly-opened fold processing according to the first embodiment.
Figure 11B:
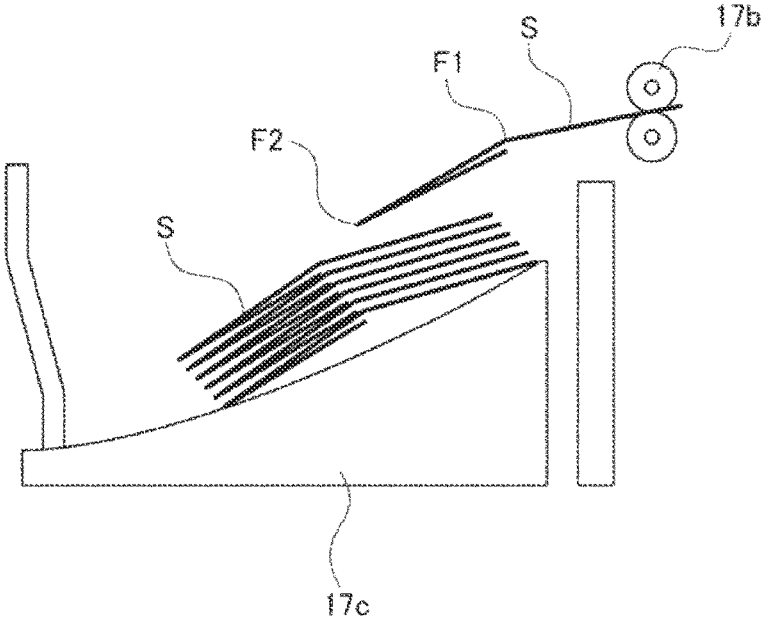
FIG. 11B is a view illustrating a state where sheets after being subjected to the partly-opened fold processing are stacked.

The sheet S discharged to the stack tray 17*c* is in a state where ⅓ of the sheet is folded inward at the second fold position F2 and the first fold position F1 is opened as illustrated in FIGS. 11A and 11B (S12). After that, the sheets having the fold line at the first fold position F1 are sequentially discharged and stacked on the already discharged sheet S in such a manner that the fold lines of the sheets overlap one another. Thus, sheet alignment performance upon discharge can be appropriately maintained.

Further, in the present embodiment, the second fold position F2 to which the second fold processing is to be applied is at a downstream location from the first fold position F1 to which the first fold processing is applied, in the sheet conveying direction toward the intermediate tray 21, so that the sheet S discharged in a state of being folded at the second fold position F2 is stacked such that one end edge of the sheet S folded inward is on the lower side of the sheet S as illustrated in FIGS. 11A and 11B. This makes the folded one end difficult to open by own weight of the sheet. Further, the sheets that have already been discharged are not pushed by the succeeding sheets, maintaining good stackability upon sheet discharge.

As described above, the sheet S in which the fold line is formed at the first fold position F1 on the upstream side in the conveying direction is fed back to the intermediate tray 21, and then the regulating stopper 26 is elevated to move the sheet S so as to make the second fold position align with the fold blade 23. At this time, the fold line is absent between the downstream side end edge E1 abutting against the regulating stopper 26 and the second fold position F2, allowing the second fold position F2 to be aligned with the fold blade 23 with high accuracy by the movement of the regulating stopper 26.

Figure 12:
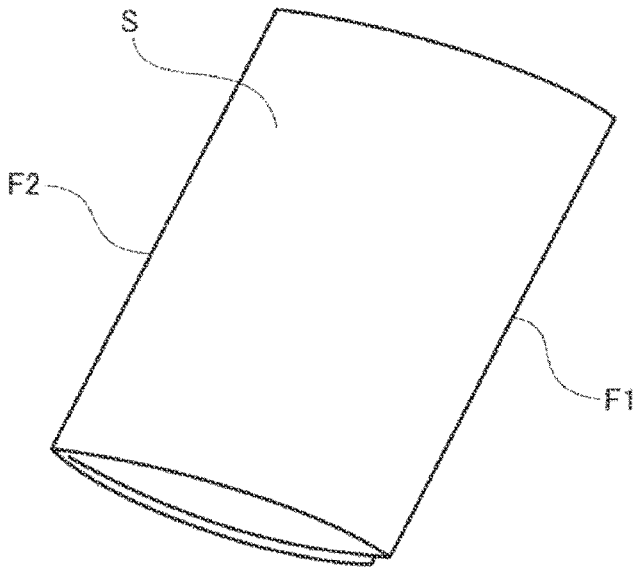
FIG. 12 is a perspective illustrating a sheet that has been folded inward in three.

The sheet S thus discharged is easily folded inward in three by folding the sheet along the first fold line, as illustrated in FIG. 12.

Figure 13B:
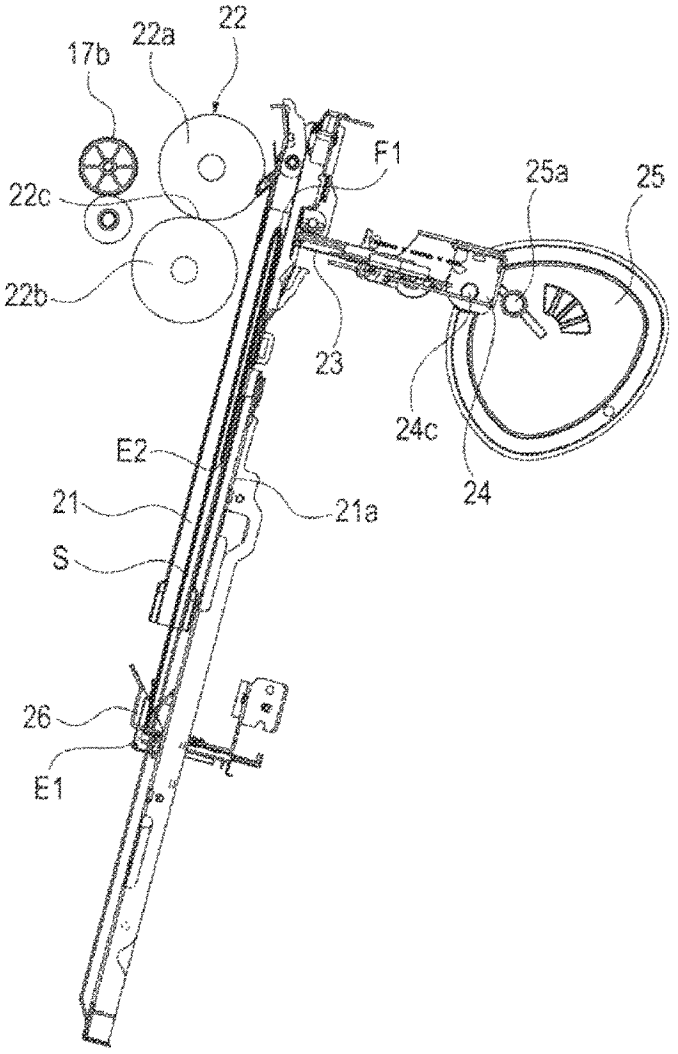
FIGS. 13A and 13B are cross-sectional views for explaining a conveying operation for a sheet that has been subjected to the inward threefold processing.
Figure 13A:
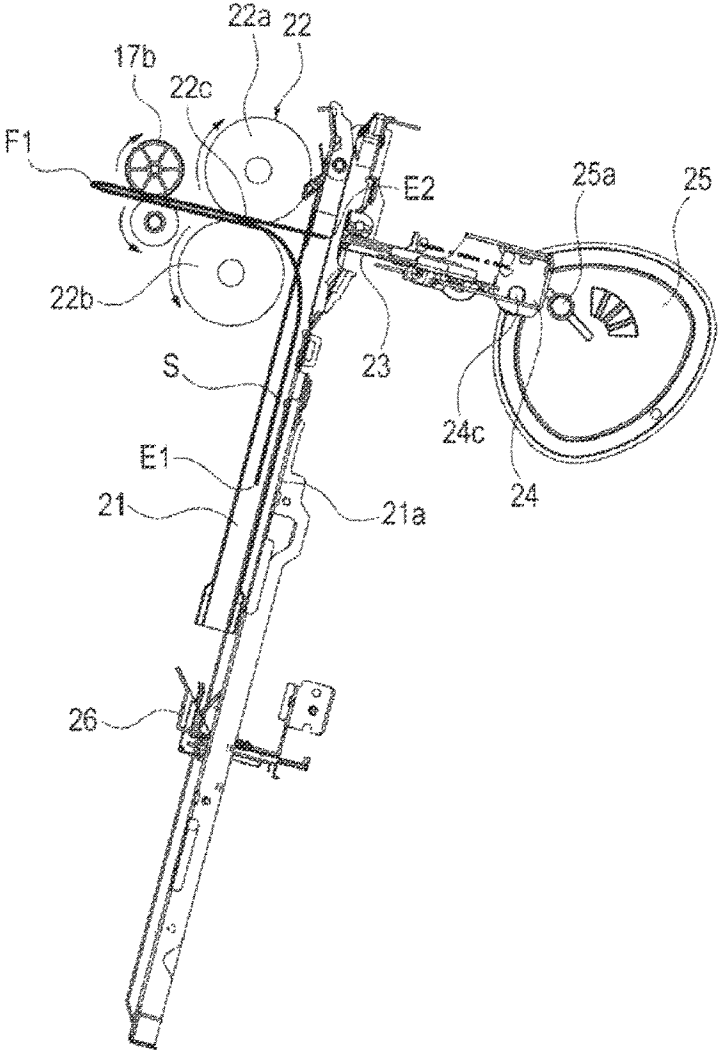

Further, in the present embodiment, it is possible to reduce the sheet conveying distance to curtail the fold processing time, as compared to a case where the sheet S is discharged in a state of being folded in three by the fold processing device F. Specifically, in a case where the sheet S is to be discharged in a state of being folded in three by the fold processing device F, the following operation needs to be performed: after the first fold processing, the fold roller pair 22 is reversely rotated after the end edge E2 of the sheet S is conveyed from the conveying path of the intermediate tray 21 toward the fold roller pair 22 as illustrated in FIG. 13A, and the sheet end edge E2 is guided to the downstream side of the conveying path of the intermediate tray 21 as illustrated in FIG. 13B. On the other hand, in the present embodiment, after the first fold processing, the fold roller pair 22 is reversely rotated before the sheet end edge E2 fully passes through the conveying path of the intermediate tray 21 for feed back to the conveying path. This reduces the sheet conveying distance, which in turn can reduce the entire fold processing time.

The above description has been made taking a case where one sheet is conveyed and folded as an example; however, a plurality of sheets may be subjected to the fold processing at a time. In this case, a plurality of sheets are sequentially conveyed to and stacked in the intermediate tray 21 with the downstream end edges E1 thereof being regulated by the regulating stopper 26, followed by simultaneous movement of the plurality of sheets for fold processing. In this manner, a plurality of sheets can be folded simultaneously, which in turn increases the productivity.

When the number of sheets to be folded simultaneously is equal to or less than a predetermined number of sheets, the present embodiment (i.e., partly-opened fold processing in which the sheet is discharged in a state where the first fold line is opened) is preferably performed. Specifically, when the sheet that has been subjected to the partly-opened fold processing is folded inward in three, additional folding needs to be performed along the first fold line after sheet discharge, so that when the number of sheets to be folded simultaneously is equal to or more than a predetermined number of sheets, the inward threefold is preferably completed in the fold processing device F as illustrated in FIGS. 13A and 13B. In this case, the sheet is discharged in a state of being folded inward in three as illustrated in FIG. 12, which saves the time and effort required for subsequent fold processing. Thus, the predetermined number of sheets may be set taking productivity into account.

Second Embodiment

The following describes a second embodiment of the sheet threefold processing with improved stackability upon sheet discharge. In the above embodiment, the first fold position F1 is located upstream relative to the second fold position F2 in the conveying direction to the intermediate tray 21; alternatively, stackability upon sheet discharge can be improved when the first fold position F1 is located downstream from the second fold position F2.

Figure 14B:
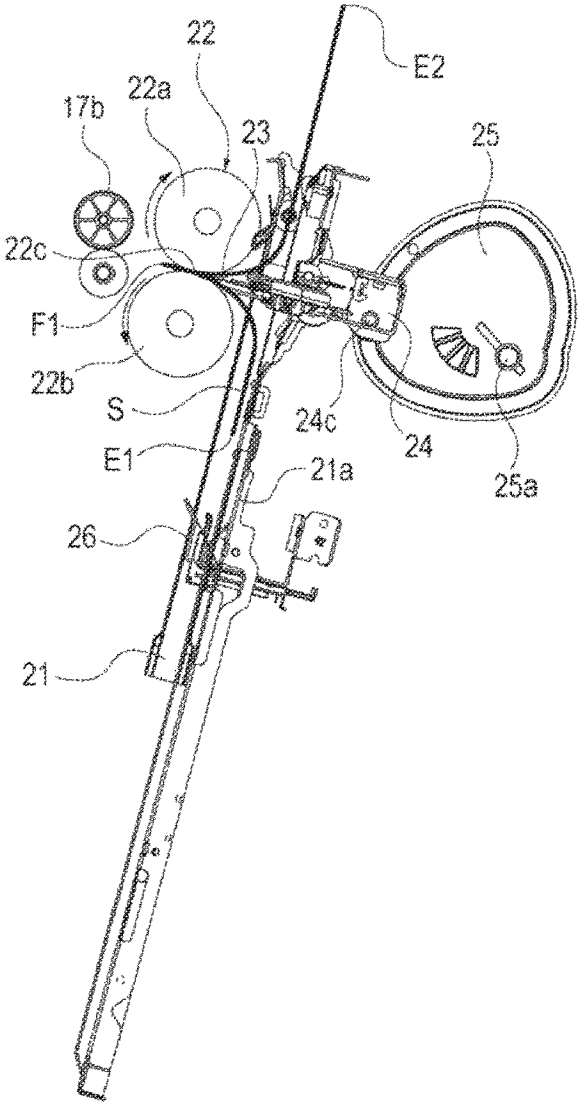
FIGS. 14A and 14B are cross-sectional view for explaining a sheet partly-opened fold processing operation according to a second embodiment.
Figure 14A:
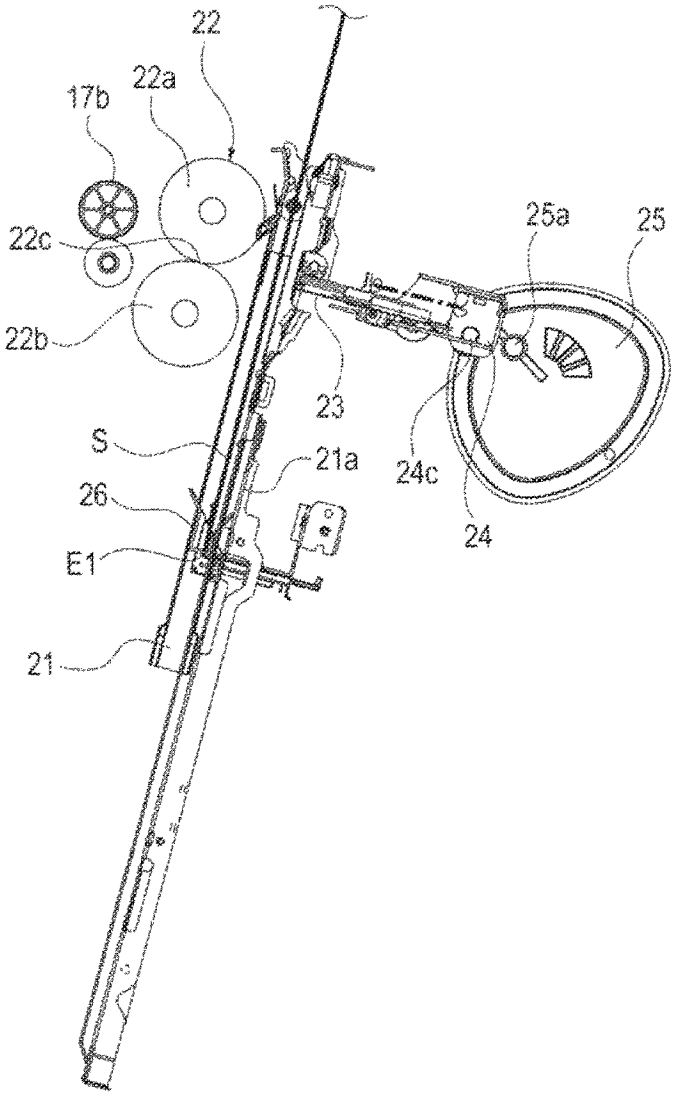

Specifically, as illustrated in FIG. 14A, the sheet conveyed to the intermediate tray 21 is stopped with the downstream side end edge E1 abutting against the regulating stopper 26. At this time, the regulating stopper 26 is located at a position where when the downstream side end edge E1 of the sheet S conveyed to the intermediate tray 21 abuts against the regulating stopper 26, the position corresponding to ⅓ of the entire length in the conveying direction of the sheet S before being folded from the downstream side end edge E1 aligns with the fold blade 23. That is, in the present embodiment, the first fold position is the position at ⅓ of the entire sheet length from the downstream side end edge E1.

In the above state, the cam motor 66 and the fold roller motor 67 are driven to perform the fold processing at the first fold position F1 (FIG. 14B). Then, the driving of the fold roller pair 22 is stopped at the point of time when the first fold position F1 passes through the nip part 22*c* by a predetermined distance. Specifically, the driving of the fold roller pair 22 is stopped during which time one (in the present embodiment, the downstream side end edge E1) of the downstream side end edge E1 and upstream side end edge E2 in the conveying direction of the sheet S that is closer to the first fold position F1 is positioned in the conveying path of the intermediate tray 21.

Then, the fold roller pair 22 is reversely rotated to feed back the sheet S in which the first fold line has been formed to the intermediate tray 21. At this time, as in the first embodiment, both the end edges E1 and E2 of the sheet S are positioned in the sheet conveying path constituted by the intermediate tray 21, so that, as illustrated in FIG. 15A, the sheet S is fed back to the sheet conveying path in an unfolded state, i.e., with the first fold line open, and the sheet S for which nip by the nip part 22*c* has been released falls until the downstream side end edge E1 abuts against the regulating stopper 26 in the sheet conveying path.

Figure 15B:
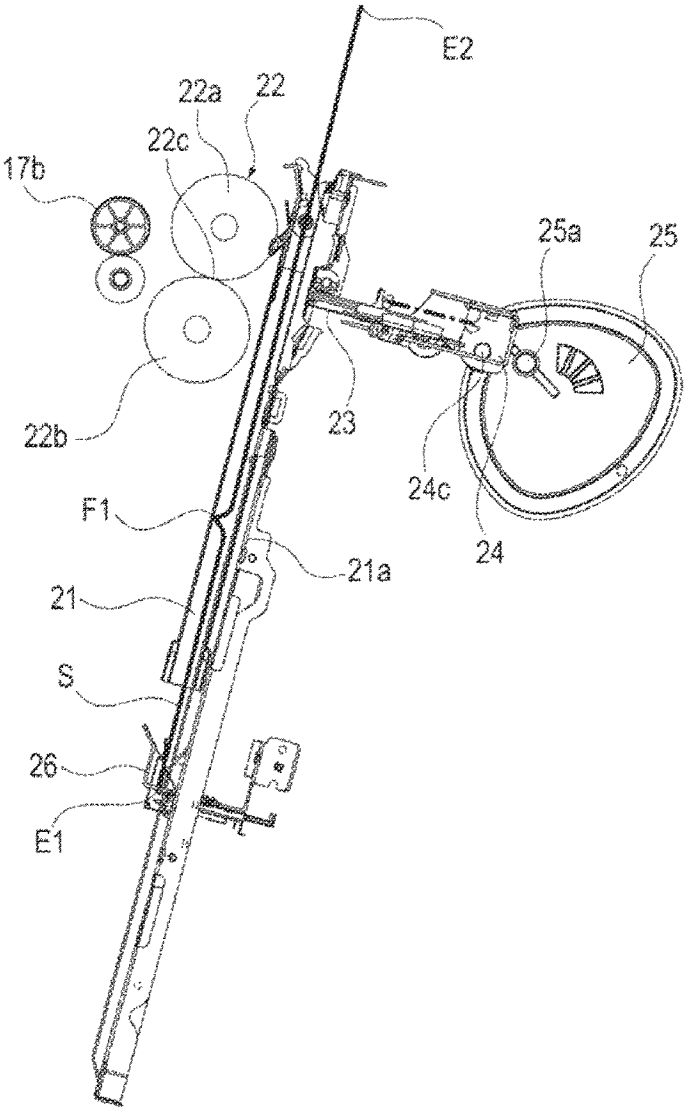
FIGS. 15A and 15B are cross-sectional view for explaining the sheet partly-opened fold processing operation according to the second embodiment.
Figure 15A:
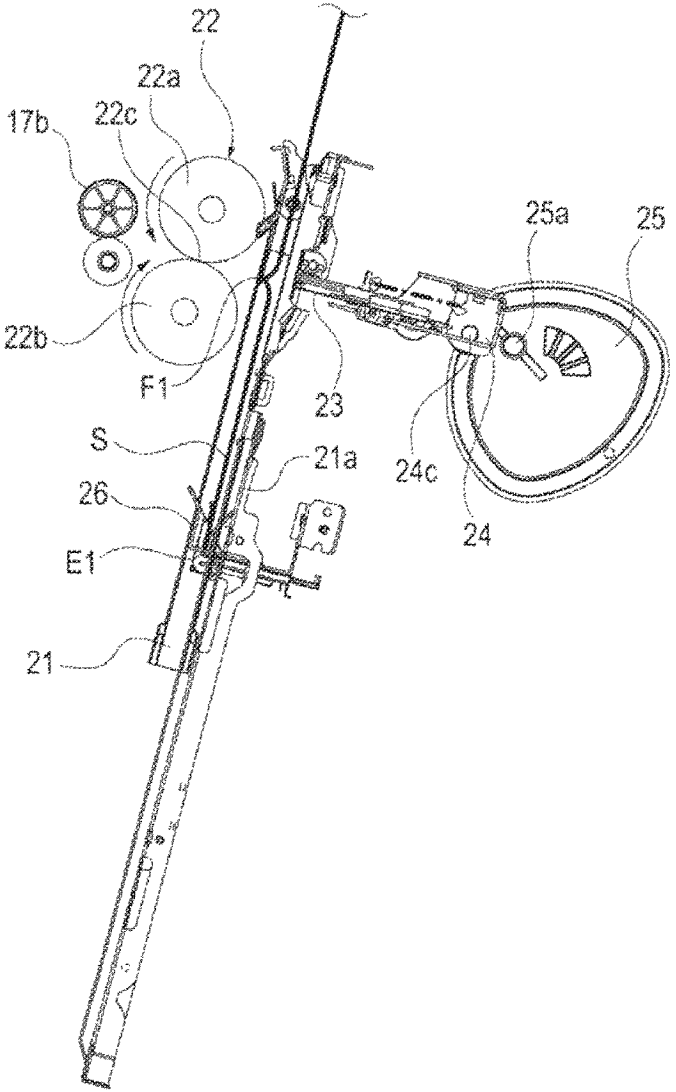

Then, for the second fold processing, as illustrated in FIG. 15B, the regulating stopper motor 65 is driven to lower the regulating stopper 26 against which the downstream side end edge E1 of the sheet S abuts so as to make the second fold position F2 of the sheet S to be formed in the second fold processing align with the fold blade 23. The second fold position F2 is a position where the position corresponding to ⅔ of the entire length in the conveying direction of the sheet S from the downstream side end edge E1 aligns with the fold blade 23.

Figure 16B:
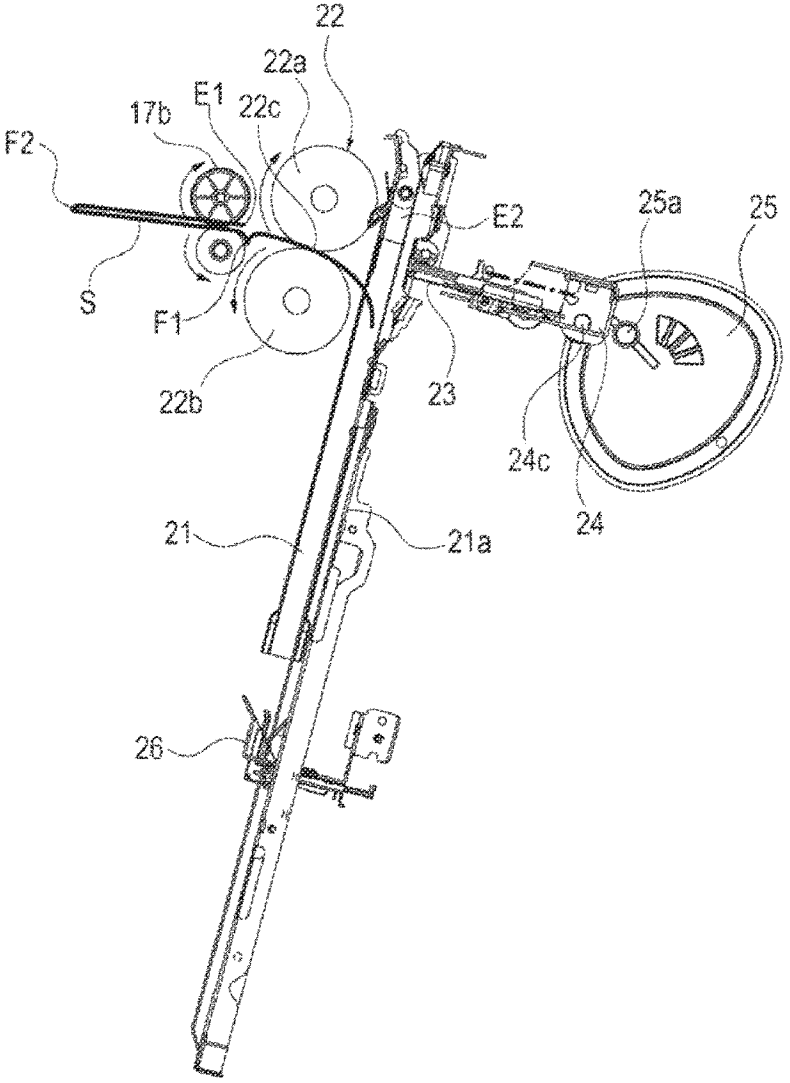
FIGS. 16A and 16B are cross-sectional view for explaining the sheet partly-opened fold processing operation according to the second embodiment.
Figure 16A:
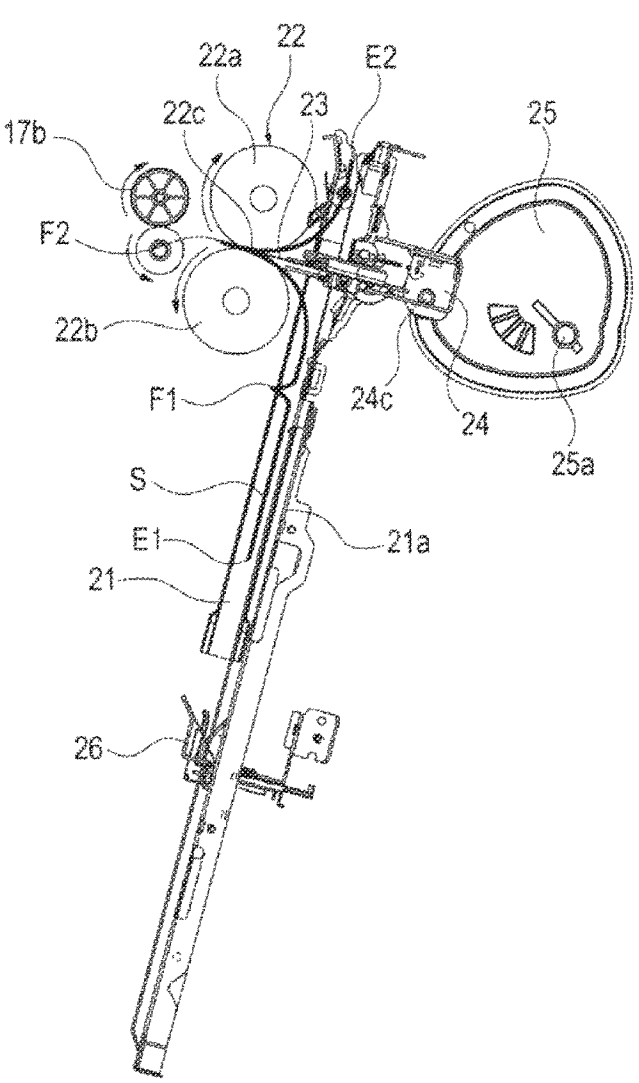
Figure 17:
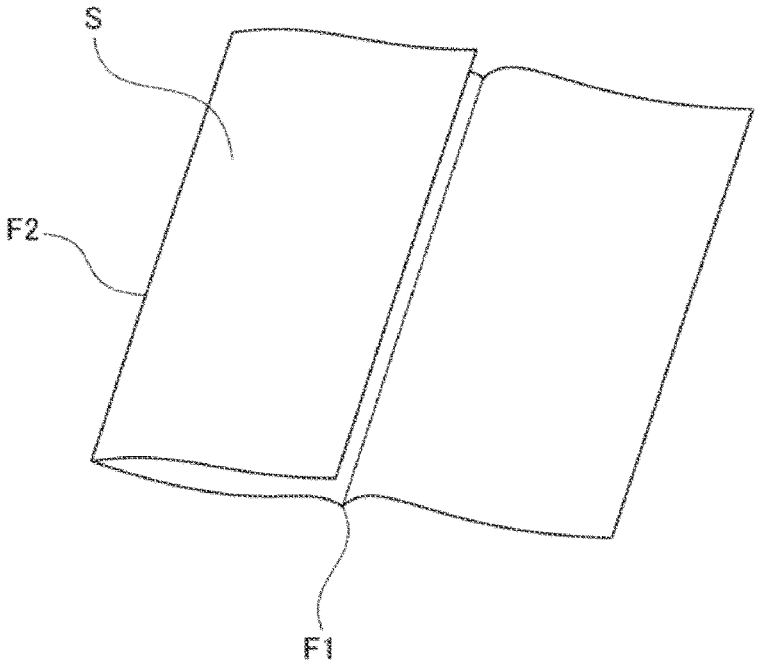
FIG. 17 is a perspective view of a sheet after being subjected to the partly-opened fold processing according to the second embodiment.

In this state, the cam motor 66 and the fold roller motor 67 are driven to perform the second fold processing (FIG. 16A), and the resultant sheet is discharged to the stack tray 17*c* (FIG. 16B). Thus, the sheet S discharged to the stack tray 17*c* is in a state where ⅓ of the sheet is folded upward at the second fold position F2 and where the first fold position F1 is opened as illustrated in FIG. 17.

Also, when the fold processing is performed in the manner as described above, sheets having the fold line at the first fold position F1 are sequentially discharged and stacked on the already discharged sheet S in such a manner that the fold lines of the sheets overlap one another. Thus, sheet alignment performance upon discharge can be appropriately maintained. Further, in the fold processing according to the present embodiment, that is, when the threefold processing is performed with the first fold position F1 positioned downstream from the second fold position, it is not necessary to switch back the sheet so as to make the second fold position F2 be aligned with the fold blade 23 after the sheet S that has been subjected to the first fold processing is fed back to the intermediate tray 21, so that the sheet conveying direction is not reversed in the intermediate tray 21. This can reduce the processing time required for the entire fold processing as compared to the above-mentioned fold processing.

Also, in the fold processing according to the present embodiment, as in the first embodiment, the nip pressure may be reduced when the first fold position F1 with the fold line passes through the nip part 22*c* once again.

Third Embodiment

In the above embodiments, a configuration has been described in which the inter-shaft distance of the roller pair is made changeable so as to reduce the nip pressure when the first fold position F1 with the fold line passes the nip part 22*c* once again; alternatively, the nip pressure may be changed by changing the roller diameter while the inter-shaft distance is fixed.

Figure 18:
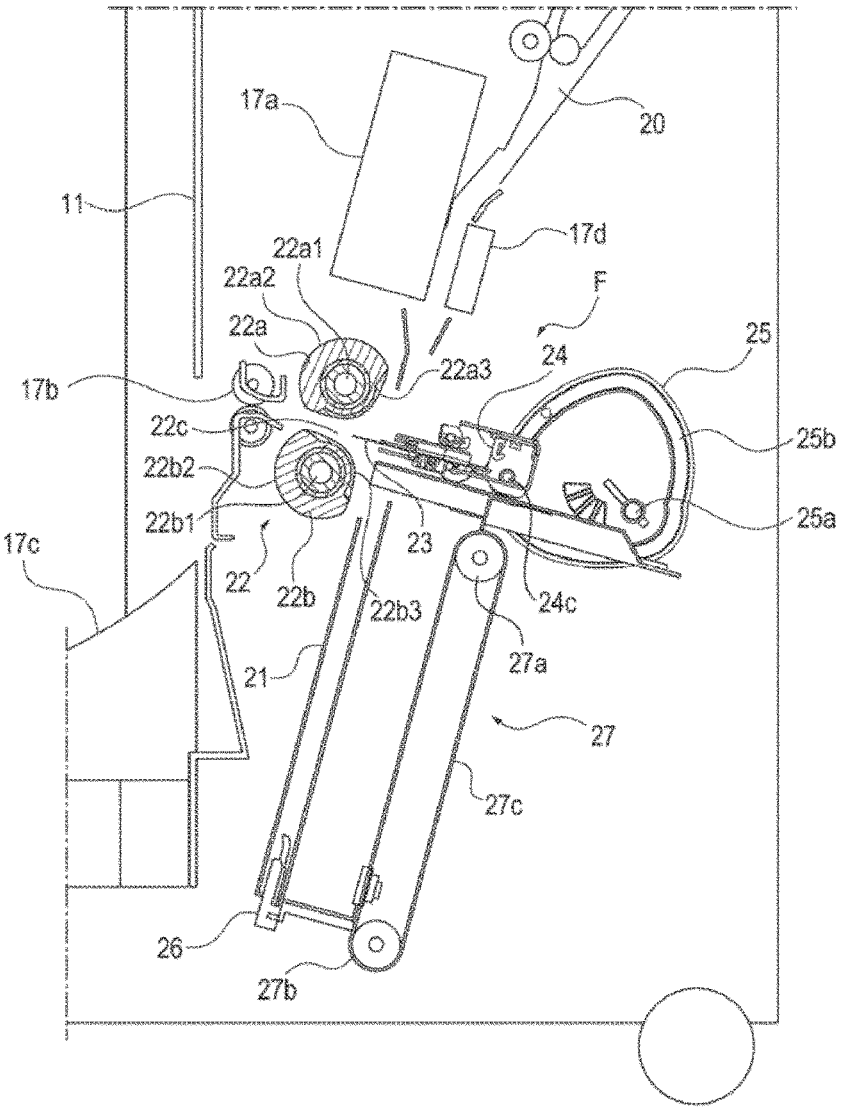
FIG. 18 is an explanatory view illustrating a pair of fold rollers each having peripheral surfaces at positions of different radial distances from the rotation axis thereof.
Figure 19:
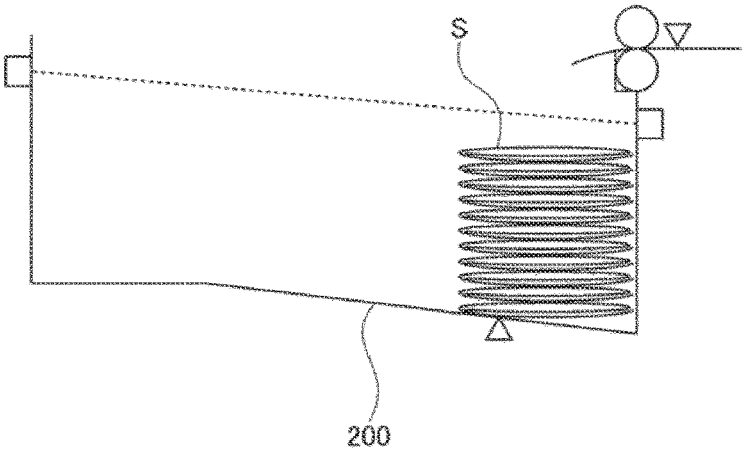
FIG. 19 is a view illustrating a state where a sheet that has been folded inward in three.

For example, as illustrated in FIG. 18, the fold rollers 22*a* and 22*b* each have a first roller surface (first peripheral surface) (22*a*2, 22*b*2) at a location at a constant distance (radius) R1 from the rotary axis of the rotary shaft (22*a*1, 22*b*1) and a second roller surface (second peripheral surface) (22*a*3, 22*b*3) at a location at a distance smaller than R1 from the rotary axis of the rotary shaft. In the present embodiment, the first roller surfaces 22*a*2 and 22*b*2 are each made of a rubber material or the like having a comparatively high friction coefficient as in the roller surface of the roller used for typical sheet conveyance, while the second roller surfaces 22*a*3 and 22*b*3 are each made of a plastic resin material or the like having a friction coefficient lower than that of the material of each of the first roller surfaces 22*a*2 and 22*b*2.

The rotary shafts 22*a*1 and 22*b*1 of the fold rollers 22*a* and 22*b* are driven into rotation by a common drive unit such as a drive motor. This allows the rotation positions of the fold rollers 22*a* and 22*b* to be always sync with each other such that the first roller surfaces 22*a*2 and 22*b*2 face each other and that the second roller surfaces 22*a*3 and 22*b*3 face each other.

When the first roller surfaces 22*a*2 and 22*b*2 face each other, they are brought into contact with each other at the nip part 22*c* at a predetermined pressing force, thereby forming a fold line in the sheet S that has been folded in two, when the sheet S passes through the nip part 22*c*. When the second roller surfaces 22*a*3 and 22*b*3 face each other, they do not contact each other, and the nip part 22*c* has a slight gap. Thus, when the second roller surfaces 22*a*3 and 22*b*3 face each other, no pressing force is applied to the sheet passing through the nip part 22*c*.

The above configuration allows the adjustment of the pressing force at the nip part 22*c* by switching between a case where a predetermined pressing force is applied to the sheet passing through the nip part 22*c* to apply fold processing and a case where the first fold position of the sheet that has been subjected to fold processing is made to pass through the nip part 22*c* at the second time in a state where the pressing force at the nip part 22*c* is made smaller than that when the first fold position passes the nip part 22*c* at the first time. Thus, unlike the first embodiment, it is not necessary to change the inter-shaft distance of the roller pair, but the pressing force can be changed only by the rotation control for the fold rollers.

Other Embodiments

In the above embodiments, a configuration that elevates and lowers the regulating stopper 26 has been described as the position adjusting unit that moves the sheet S conveyed to the conveying path constituted by the intermediate tray 21 in the conveying direction and its opposite direction; alternatively, configurations other than the regulating stopper 26 may be used as the position adjusting unit. For example, an upstream side conveying roller pair (first conveying roller pair) and a downstream side conveying roller pair (second conveying roller pair) capable of nipping and conveying a sheet are provided at upstream and downstream locations relative to the fold roller pair 22 in the sheet conveying direction, and these conveying roller pairs are normally and reversely rotated to convey the sheet to a desired position.

When the sheet position is made adjustable by the conveying roller pairs as described above, main components for adjusting the sheet position can be concentrated around the fold roller pair 22, so that the device can be easily downsized. Further, the conveying roller pairs can always convey the sheet in a nipping manner, allowing the sheet to be moved to the fold positions with high accuracy.

When the sheet is moved to a desired position by the conveying roller pairs as described above, the sheet S can be thrust toward the nip part without using the fold blade 23 which is used in the above first embodiment as a biasing unit. For example, when the upstream side conveying roller pair and downstream side conveying roller pair are mutually reversely rotated, the sheet becomes slack so as to form a loop at the fold position, and the loop portion (fold position) is directed to the nip part 22*c* to be nipped thereat. Thus, unlike the first embodiment, it is not necessary to provide the fold blade 23 and a cam member for moving the fold blade 23, allowing for further device downsizing.

This application claims the benefit of Japanese Patent Application No. 2020-201457 which is incorporated herein by reference.

The invention claimed is:

1. A sheet processing apparatus comprising:

a conveying path that guides a sheet conveyed in a predetermined conveying direction;

a position adjusting unit that moves the sheet conveyed to the conveying path in the conveying direction of the conveying path and its opposite direction so as to adjust the position of the sheet;

a fold rotating body pair disposed opposite to a surface of the sheet conveyed to the conveying path, having a nip part that nips a first fold position extending in a sheet width direction intersecting the conveying direction of the sheet conveyed to the conveying path and a second fold position extending in the sheet width direction at a different position from the first fold position to apply fold processing to the sheet, and configured to be rotatable in a first direction so as to perform the fold processing and in a second direction opposite to the first direction so as to feed back the sheet to the conveying path;

a biasing unit that biases the first and second fold positions of the sheet that have been adjusted by the position adjusting unit toward the nip part of the fold rotating body pair; and a control unit that controls the position adjusting unit, fold rotating body pair, and biasing unit to perform partly-opened fold processing, the partly-opened fold processing including: forming a first fold line at the first fold position of the sheet position-adjusted by the position adjusting unit and biased by the biasing unit by rotating the fold rotating body pair in the first direction; stopping the rotation of the fold rotating body pair during which time one of upstream and downstream side end edges of the sheet in the conveying direction that is closer to the first fold line is positioned in the conveying path and then rotating the fold rotating body pair in the second direction to feed back the sheet while opening the first fold line at which the fold processing has been applied; and applying fold processing at the second fold position position-adjusted by the position adjusting unit and biased by the biasing unit by rotating the fold rotating body pair in the first direction.

2. The sheet processing apparatus according to claim 1, wherein the control unit controls the position adjusting unit, the fold rotating body pair, and the biasing unit so as to apply the fold processing at the first fold position of the sheet conveyed to the conveying path and the second fold position located downstream from the first fold position in the conveying direction.

3. The sheet processing apparatus according to claim 1, wherein the control unit controls the position adjusting unit, the fold rotating body pair, and the biasing unit so as to apply the fold processing at the first fold position of the sheet conveyed to the conveying path and the second fold position located upstream relative to the first fold position in the conveying direction.

4. The sheet processing apparatus according to claim 1, wherein the position adjusting unit includes a positioning member against which a downstream side end portion in the conveying direction of the sheet conveyed to the conveying path abuts and a moving unit configured to move the positioning member along the conveying path.

5. The sheet processing apparatus according to claim 1, further comprising a pressure changing unit configured to change a press contact force at the nip part, wherein the control unit controls the pressure changing unit so as to make the press contact force at the nip part smaller when the first fold position that has been subjected to fold processing by an operation in which the sheet is passed through the nip part of the fold rotating body pair passes through the nip part once again than that when the fold processing is applied.

6. The sheet processing apparatus according to claim 1, wherein the fold rotating body pair has first peripheral surfaces each being at a location at a constant distance from a center of the fold rotating body and brought into contact with each other at the nip part to allow fold processing and second peripheral surfaces each being at a location at a distance from the fold rotating body center smaller than the distance between the first peripheral surface and the fold rotating body center and not brought into contact with each other at the nip part, and the control unit controls the rotation of the fold rotating body pair such that the first peripheral surfaces face each other at the nip part of the fold rotating body pair when fold processing is applied to the sheet and that the second peripheral surfaces face each other when the first fold position at which the first fold line has been formed passes through the nip part.

7. The sheet processing apparatus according to claim 1, wherein the control unit performs the partly opened fold processing when the number of sheets to be folded by the fold rotating body pair is equal to or less than a predetermined number of sheets.

8. An image forming system comprising:

an image forming apparatus that forms images on a sheet; and a sheet processing apparatus that applies fold processing to a sheet fed from the image forming apparatus, wherein the sheet processing apparatus is the sheet processing apparatus as claimed in claim 1.

* * * * *